US010425745B1

(12) United States Patent
Merks et al.

(10) Patent No.: US 10,425,745 B1
(45) Date of Patent: Sep. 24, 2019

(54) ADAPTIVE BINAURAL BEAMFORMING WITH PRESERVATION OF SPATIAL CUES IN HEARING ASSISTANCE DEVICES

(71) Applicant: Starkey Laboratories, Inc., Eden Prairie, MN (US)

(72) Inventors: Ivo Merks, Eden Prairie, MN (US); John Ellison, Minneapolis, MN (US); Jinjun Xiao, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/982,820

(22) Filed: May 17, 2018

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01); *H04R 25/552* (2013.01); *H04R 25/554* (2013.01)

(58) Field of Classification Search
CPC .. H04R 25/405; H04R 25/407; H04R 25/505; H04R 25/552; H04R 25/554
USPC ..... 381/23.1, 60, 309, 330
See application file for complete search history.

(56) References Cited

U.S. PATENT DOCUMENTS

| | | | |
|---|---|---|---|
| 5,473,701 | A | 12/1995 | Cezanne et al. |
| 5,511,128 | A | 4/1996 | Lindemann |
| 5,651,071 | A | 7/1997 | Lindemann et al. |
| 6,983,055 | B2 | 1/2006 | Luo |
| 7,149,320 | B2 | 12/2006 | Haykin et al. |
| 7,206,421 | B1 | 4/2007 | Taezner |
| 8,027,495 | B2 | 9/2011 | Roeck |
| 8,139,787 | B2 | 3/2012 | Haykin et al. |
| 8,660,281 | B2 | 2/2014 | Bouchard et al. |
| 9,282,411 | B2 | 3/2016 | Gran |
| 9,986,346 | B2 | 5/2018 | Bendsen |

(Continued)

FOREIGN PATENT DOCUMENTS

| | | | |
|---|---|---|---|
| EP | 1465456 A2 | 10/2004 | |
| EP | 2395506 A1 * | 12/2011 | ..... G01L 21/0208 |

(Continued)

OTHER PUBLICATIONS

Boyd et al., "Convex Optimization," Cambridge University Press, Mar. 8, 2004, 730 pp.

(Continued)

*Primary Examiner* — William A Jerez Lora
(74) *Attorney, Agent, or Firm* — Shumaker & Sieffert, P.A.

(57) ABSTRACT

A hearing assistance system obtains a first input audio signal that is based on sound received by a first set of microphones. The system also obtains a second input audio signal that is based on sound received by a second, different set of microphones. A first adaptive beamformer generates a first output audio signal based on the first input audio signal, the second input audio signal, and a value of a first parameter. A second adaptive beamformer generates a second output audio signal based on the first input audio signal, the second input audio signal, and a value of a second parameter. The value of the first parameter and the value of the second parameter are determined such that a magnitude squared coherence (MSC) of the first output audio signal and the second output audio signal is less than or equal to the coherence threshold.

25 Claims, 14 Drawing Sheets

(56) References Cited

U.S. PATENT DOCUMENTS

| | | | | |
|---|---|---|---|---|
| 2004/0196994 | A1* | 10/2004 | Kates | H04R 25/407 381/320 |
| 2008/0260175 | A1* | 10/2008 | Elko | H04R 3/005 381/73.1 |
| 2010/0002886 | A1 | 1/2010 | Doclo et al. | |
| 2015/0131814 | A1* | 5/2015 | Usher | G06F 3/017 381/123 |
| 2015/0172814 | A1* | 6/2015 | Usher | H04R 3/005 381/92 |
| 2016/0080873 | A1 | 3/2016 | Guo et al. | |
| 2017/0084288 | A1* | 3/2017 | Chatlani | G10L 21/0216 |

FOREIGN PATENT DOCUMENTS

| | | | |
|---|---|---|---|
| EP | 2986026 | A1 | 2/2016 |
| WO | 2009072040 | A1 | 6/2009 |
| WO | 2010004473 | A1 | 1/2010 |

OTHER PUBLICATIONS

Doclo et at, "Reduced-Bandwidth and Distributed MWF-Based Noise Reduction Algorithms for Binaural Hearing Aids," IEEE Transactions on Audio, Speech, and Language Processing, vol. 17, No. 1, Jan. 2009, pp. 38-51.

Doclo et al., "Acoustic Beamforming for Hearing Aid Applications," Handbook on Array Processing and Sensor Networks, Chapter 10, 2008 (Applicant points out, in accordance with MPEP 609.04(a), that the year of publication, 2008, is sufficiently earlier than the effective U.S. filing date, 2018, so that the particular month of publication is not in issue.) 34 pp.

Elko et al., "A Steerable and Variable First-Order Differential Microphone Array," 1997 IEEE International Conference on Acoustics, Speech, and Signal Processing, Apr. 21-24, 1997, 4 pp.

Kates et al., Digital Hearing Aids, Chapters 4-5, 2008 (Applicant points out, in accordance with MPEP 609.04(a), that the year of publication, 2008, is sufficiently earlier than the effective U.S. filed, 2018, so that the particular month of publication is not in issue.) pp. 75-145.

Kates et al., Digital Hearing Aids, Chapter 7, 2008 (Applicant points out, in accordance with MPEP 609.04(a), that the year of publication, 2008, is sufficiently earlier than the effective U.S. filing date, 2018, so that the particular month of publication is not in issue.) pp. 175-221.

Kochkin, "10-Year Customer Satisfaction Trends in the US Hearing Instrument Market," The Hearing Review, Oct. 2002, 8 pp.

Marquardt et al., "Theoretical Analysis of Linearly Constrained Multi-Channel Wiener Filtering Algorithms for combined Noise Reduction and Binaural Cue Preservation in Binaural Hearing Aids," IEEE/ACM Transactions on Audio, Speech, and Language Processing, vol. 23, No. 12, Dec. 2015, pp. 2384-2397.

Hadad et al., "Comparison of Two Binaural Beamforming Approaches for Hearing Aids," 2017 IEEE International Conference on Acoustics, Speech and Signal Processing (ICASSP), Mar. 5-9, 2017, pp. 236-240.

Koutrouvelis et al., "Relaxed Binaural LCMV Beamforming," IEEE/ACM Transactions on Audio, Speech, and Language Processing, vol. 25, No. 1, Jan. 2017, 15 pp.

Latzel et al., "Concepts for Binaural Processing in Hearing Aids," Hearing Review, Mar. 28, 2013, 5 pp.

Appleton et al., "Improvement in Speech Intelligibility and Subjective Benefit with Binaural Beamformer Technology," Hearing Review, Oct. 31, 2014, 5 pp.

Lombard et al., "Combination of Adaptive Feedback Cancellation and Binaural Adaptive Filtering in Hearing Aids," EURASIP Journal on Advances in Signal Processing, Dec. 2009, 15 pp.

Kamkar-Parsi et al., "New Binaural Strategies for Enhanced Hearing," Hearing Review, Oct. 20, 2014, 5 pp.

Bronkhorst et al., "Effect of Multiple Speechlike Maskers on Binaural Speech Recognition in Normal and Impaired Hearing," The Journal of the Acoustical Society of America, vol. 92, No. 6, pp. 3132-3139.

Jeub et al., "A Semi-Analytical Model for the Binaural Coherence of Noise Fields," IEEE Signal Processing Letters, vol. 18, No. 3, pp. 197-200.

Liao et al., "An Effective Low Complexity Binaural Beamforming Algorithm for Hearing Aids," 2015 IEEEWorkshop on Applications of Signal Processing to Audio and Acoustics. Oct. 18-21, 2015, 5 pp.

Liao et al., "Incorporating Spatial Information in Binaural Beamforming for Noise Suppression in Hearing Aids," 2015 IEEE International Conference on Acoustics, Speech and Signal Processing (ICASSP), Apr. 19-24, 2015, pp. 5733-5737.

Picou et al., "Potential Benefits and Limitations of Three Types of Directional Processing in Hearing Aids," Ear and Hearing, vol. 35, No. 3, Feb. 2014, pp. 339-352.

Welker et al., "Microphone-Array Hearing Aids with Binaural Output—Part II: A Two-Microphone Adaptive System," IEEE Transactions on Speech and Audio Processing, vol. 5, No. 6, Nov. 1997, pp. 543-551.

Woods et al, "Assessing the Benefit of Adaptive Null-Steering Using Real-World Signals," International Journal of Audiology, vol. 49, Nov. 25, 2009, pp. 434-443.

Woods et al., "Limitations of theoretical benefit from an adaptive directional system in reverberant environments," Acoustics Research Letters Online, vol. 5, No. 4, Aug. 13, 2004, pp. 153-157.

Neher et al., "Directional Processing and Noise Reduction in Hearing Aids: Individual and Situational Influences on Preferred Setting," Abstract Only, Journal of the American Academy of Audiology, vol. 27, No. 8, Sep. 2016, 1 pp.

Merks et al., "Sound Source Localization With Binaural Hearing Aids Using Adaptive Blind Channel Identification," 2013 IEEE International Conference on Acoustics, Speech and Signal Processing, May 26-31, 2013, 5 pp.

Kochkin et al., "Marketrak VIII: Consumer Satisfaction With Hearing Aids is Slowly Increasing," The Hearing Journal, vol. 63, No. 1, Jan. 2010, pp. 19-32.

Dillon, "Directional Microphone Technology," Hearing Aids. Turramurra. New South Wales, Australia: Boomerang Press, 2012 (Applicant points out, in accordance with MPEP 609.04(a), that the year of publication, 2012, is sufficiently earlier than the effective U.S. filed, 2018, so that the particular month of publication is not in issue.) pp. 199-200.

Dillon, "Digital Circuits," Hearing Aids. Turramurra. New South Wales, Australia: Boomerang Press, 2012 (Applicant points out, in accordance with MPEP 609.04(a), that the year of publication, 2012, is sufficiently earlier than the effective U.S. filed, 2018, so that the particular month of publication is not in issue.) pp. 35-36.

Enzer et al., "Adaptive Filter Algorithms and Misalignment Criteria for Blind Binaural Channel Identification in Hearing Aids," 20th European Signal Processing Conference (EUSIPCO 2012), Aug. 27-31, 2012, pp. 315-318.

"WOLA Filterbank Coprocessor: Introductory Concepts and Techniques," AND8382/D, Semiconductor Components Industries, LLC, Apr. 2009, 51 pp.

"Gradients and Conntour Curves," retrieved from https://www-old.math.gatech.edu/academic/courses/core/math2401/Carlen/GradientAndContour.html. on Mar. 12, 2019, 3 pp.

Merks, Binaural application of microphone arrays for improved speech intelligibility in Noise, Doctoral dissertation, TU Delft, Delft University of Technology, Aug. 1999, 1 pp.

"Method of Measurement of Performance Characteristics of Hearing Aids Under Simulated Real-Ear Working Conditions," American National Standards Institute, Inc., Feb. 25, 2010, 47 pp.

Xiao et al., "Evaluation of a Novel Robust Adaptive Binaural Beamforming Algorithm for Hearing Aids," Starkey Hearing Technologies, 2016 (Applicant points out, in accordance with MPEP 609.04(a), that the year of publication, 2016, is sufficiently earlier than the effective U.S. filing date, so that the particular month of publication is not in issue.) 1 pp.

Neher et al., "Investigating Candidacy for Different Bilateral Directional Processing Schemes: Screening, Grouping, and Character-

(56) References Cited

OTHER PUBLICATIONS ization of Participants," 2016 (Applicant points out, in accordance with MPEP 609.04(a), that the year of publication, 2016, is sufficiently earlier than the effective U.S. filing date, so that the particular month of publication is lot in issue.) 1 pp.
Internationai Search Report and Written Opinion of International Application No. PCT/U32019/032717, dated Jul. 4. 2019, 16 pp.
Jeub et al., "Model-Based Dereverberation Preserving Binaurai Cues" IEEE Transactions on Audio, Speech, and Language Processing. vol. 18, No. 7, Sep. 2010, 14 pp.
Failer et al., "Source localization in complex listening situations: Selection of binaural cues based on interaurai coherence". J. Acoust. Soc. Am. 116 (5), Nov. 2004, pp. 3075-3089).

* cited by examiner

ADAPTIVE BINAURAL BEAMFORMING WITH PRESERVATION OF SPATIAL CUES IN HEARING ASSISTANCE DEVICES

TECHNICAL FIELD

This disclosure relates to hearing assistance devices.

BACKGROUND

A user may use one or more hearing assistance devices to enhance the user's ability to hear sound. Example types of hearing assistance devices include hearing aids, cochlear implants, and so on. A typical hearing assistance device includes one or more microphones. The hearing assistance device may generate a signal representing a mix of sounds received by the one or more microphones and output an amplified version of the received sound based on the signal.

Problems of speech intelligibility are common among users of hearing assistance devices. In other words, it may be difficult for a user of a hearing assistance device to differentiate speech sounds from background sounds or other types of sounds. Binaural beamforming is a technique designed to increase the relative volume of voice sounds output by hearing assistance devices relative to other sounds. That is, binaural beamforming may increase the signal-to-noise ratio. A user of hearing assistance devices that use binaural beamforming wear two hearing assistance devices, one for each ear. Hence, the hearing assistance devices are said to be binaural. The binaural hearing assistance devices may communicate with each other. In general, binaural beamforming works by selectively canceling sounds that do not originate from a focal direction, such as directly in front of the user, while potentially reinforcing sounds that originate from the focal direction. Thus, binaural beamforming may suppress noise, where noise is considered to be sound not originating from the focal direction.

SUMMARY

This disclosure describes techniques for binaural beamforming in a way that preserves binaural cues. In one example, this disclosure describes a method for hearing assistance, the method comprising: obtaining a first input audio signal that is based on sound received by a first set of microphones associated with a first hearing assistance device; obtaining a second input audio signal that is based on sound received by a second, different set of microphones associated with a second hearing assistance device, the first and second hearing assistance devices being wearable concurrently on different ears of a same user; determining a coherence threshold; applying a first adaptive beamformer to the first input audio signal and the second input audio signal, the first adaptive beamformer generating a first output audio signal based on the first input audio signal, the second input audio signal, and a value of a first parameter; applying a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold; outputting, by the first hearing assistance device, the first output audio signal; and outputting, by the second hearing assistance device, the second output audio signal.

In another example, this disclosure describes a hearing assistance system comprising: a first hearing assistance device; a second hearing assistance device, the first and second hearing assistance devices being wearable concurrently on different ears of a same user; and one or more processors configured to: obtain a first input audio signal that is based on sound received by a first set of microphones associated with a first hearing assistance device; obtain a second input audio signal that is based on sound received by a second, different set of microphones associated with a second hearing assistance device; determine a coherence threshold; apply a first adaptive beamformer to the first input audio signal and the second input audio signal, the first adaptive beamformer generating a first output audio signal based on the first input audio signal, the second input audio signal, and a value of a first parameter; and apply a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold, wherein the first hearing assistance device is configured to output the first output audio signal, and wherein the first hearing assistance device is configured to output the second output audio signal.

In another example, this disclosure describes a non-transitory computer-readable storage medium having instructions stored thereon that, when executed, cause on or more processors of a hearing assistance system to: obtain a first input audio signal that is based on sound received by a first set of microphones associated with a first hearing assistance device; obtain a second input audio signal that is based on sound received by a second, different set of microphones associated with a second hearing assistance device, the first and second hearing assistance devices being wearable concurrently on different ears of a same user; determine a coherence threshold; apply a first adaptive beamformer to the first input audio signal and the second input audio signal, the first adaptive beamformer generating a first output audio signal based on the first input audio signal, the second input audio signal, and a value of a first parameter; apply a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold; output, by the first hearing assistance device, the first output audio signal; and output, by the second hearing assistance device, the second output audio signal.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

A drawback of binaural beamforming is that it may distort the spatial and binaural cues that a user uses for localization of sound sources. However, in addition to suppressing noise, it may be desirable for a practical binaural beamformer to also limit the amount of bidirectional data transfer between the two hearing assistance devices; allow for feedback cancelation in an effective and efficient manner; be robust against microphone mismatches and misplacement; and/or enable the user to preserve spatial awareness (i.e., the ability to localize sound sources).

A hearing assistance system implementing techniques in accordance with examples of this disclosure may improve speech intelligibility in noise while still providing some spatial cues. Furthermore, the hearing assistance system may be implemented with a minimal amount of wireless communication and computational complexity. A hearing assistance system implementing techniques of this disclosure may provide an adaptive beamformer that suppresses noise more effectively in a non-diffuse noise environment, may provide low computational complexity (a few multiplications/additions and one division per update), may provide low wireless transmission requirement (one signal per side), and/or may provide flexibility to tradeoff noise suppression and spatial cue preservation, which offers customization possibility to different environments or users.

One reason that binaural beamforming distorts the spatial and binaural cues is that the sounds output by hearing assistance devices to the user's left and right ears may be too similar. That is, the correlation between the sounds output to the user's left and right ears is too high. As described herein, a hearing assistance system implementing techniques of this disclosure may generate a first and a second output audio signal based on first and second parameters. The hearing assistance system may determine the first and second parameters such that a magnitude squared coherence (MSC) of the first output audio signal and the second output audio signal is less than or equal to a coherence threshold. In this way, the hearing assistance system may limit the amount of coherence in the sounds output to the user's left and right ears, thereby potentially preserving spatial cues.

Figure 1:
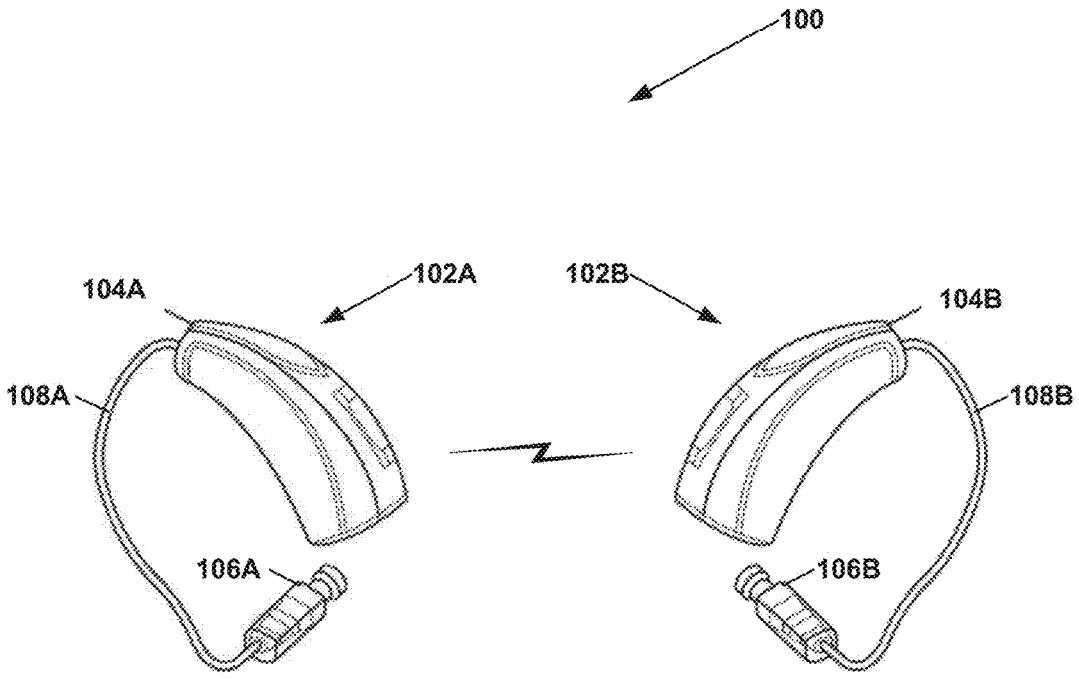
FIG. 1 illustrates an example hearing assistance system that includes a first hearing assistance device and a second hearing assistance device, in accordance with one or more techniques of this disclosure.

FIG. 1 illustrates an example hearing assistance system 100 that includes a first hearing assistance device 102A and a second hearing assistance device 102B, in accordance with one or more techniques of this disclosure. This disclosure may refer to hearing assistance device 102A and hearing assistance device 102B collectively as hearing assistance devices 102. Hearing assistance devices 102 may be wearable concurrently in different ears of the same user.

In the example of FIG. 1, hearing assistance device 102A includes a behind-the-ear (BTE) unit 104A, a receiver unit 106A, and a communication cable 108A.

Communication cable 108A communicatively couples BTE unit 104A and receiver unit 106A. Similarly, hearing assistance device 102B includes a BTE unit 104B, a receiver unit 106B, and a communication cable 108B. Communication cable 108B communicatively couples BTE unit 104B and receiver unit 106B. This disclosure may refer to BTE unit 104A and BTE unit 104B collectively as BTE units 104. Additionally, this disclosure may refer to receiver unit 106A and receiver unit 106B as collectively receiver units 106. This disclosure may refer to communication cable 108A and communication cable 108B collectively as communication cables 108.

In other examples of this disclosure, hearing assistance system 100 includes other types of hearing assistance devices. For example, hearing assistance system 100 may include in-the-ear (ITE) devices. Example types of ITE devices that may be used with the techniques of this disclosure may include invisible-in-canal (IIC) devices, completely-in-canal (CIC) devices, in-the-canal (ITC) devices, and other types of hearing assistance devices that reside within the user's ear. In instances where the techniques of this disclosure are implemented in ITE devices, the functionality and components described in this disclosure with respect to BTE unit 104A and receiver unit 106A may be integrated into a single ITE device and the functionality and components described in this disclosure with respect to BTE unit 104B and receiver unit 106B may be integrated into a single ITE device. In some examples, smaller devices (e.g., CIC devices and ITC devices) each include only one microphone; other devices (e.g., RIC devices and BTE devices) may include two or more microphones.

In the example of FIG. 1, hearing assistance device 102A may wirelessly communicate with hearing assistance device 102B and hearing assistance device 102B may wirelessly communicate with hearing assistance device 102A. In some examples, BTE units 104 include transmitters and receivers (e.g., transceivers) that support wireless communication between hearing assistance devices 102. In some examples, receiver units 106 include such transmitters and receivers (e.g., transceivers) that support wireless communication between hearing assistance devices 102. In accordance with the techniques of this disclosure, hearing assistance devices 102 implement adaptive binaural beamforming in a way that preserves spatial cues. These techniques are described in detail below.

Figure 2:
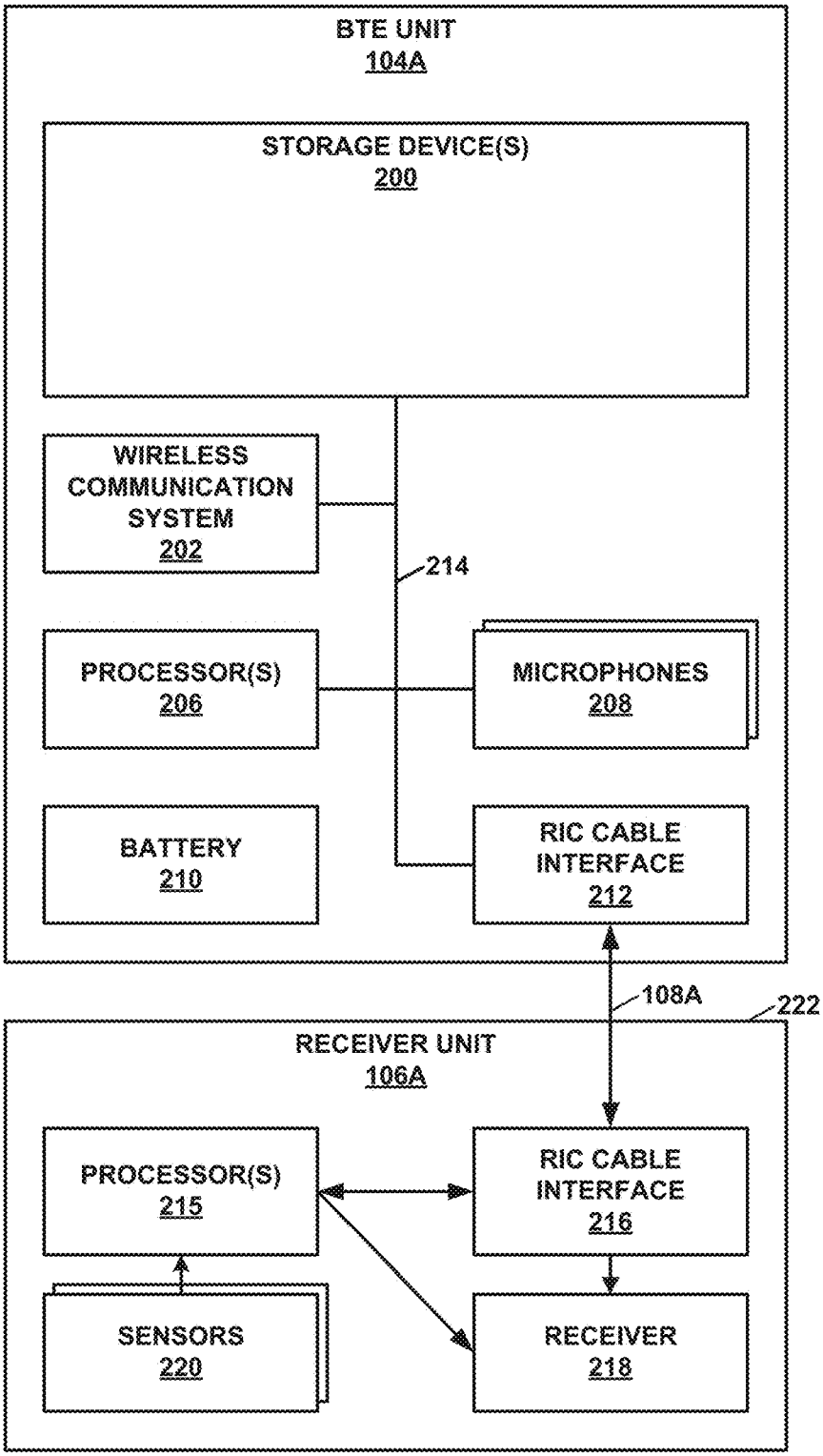
FIG. 2 is a block diagram illustrating example components of a hearing assistance device that includes a behind-the-ear (BTE) unit and a receiver unit configured according to one or more techniques of this disclosure.

FIG. 2 is a block diagram illustrating example components of hearing assistance device 102A that includes BTE unit 104A and receiver unit 106A configured according to one or more techniques of this disclosure. Hearing assistance device 102B may include similar components to those shown in FIG. 2.

In the example of FIG. 2, BTE unit 104A includes one or more storage device(s) 200, a wireless communication system 202, one or more processor(s) 206, one or more microphones 208, a battery 210, a cable interface 212, and one or more communication channels 214. Communication channels 214 provide communication between storage device(s) 200, wireless communication system 202, processor(s) 206, microphones 208, and cable interface 212. Storage devices 200, wireless communication system 202, processors 206, microphones 208, cable interface 212, and communication channels 214 may draw electrical power from battery 210, e.g., via appropriate power transmission circuitry. In other examples, BTE unit 104A may include more, fewer, or different components. For instance, BTE unit 104A may include a wired communication system instead of a wireless communication system.

Furthermore, in the example of FIG. 2, receiver unit 106A includes one or more processors 215, a cable interface 216, a receiver 218, and one or more sensors 220. In other examples, receiver unit 106A may include more, fewer, or different components. For instance, in some examples receiver unit 106A does not include sensors 220 or receiver unit 106A may include an acoustic valve that provides occlusion when desired. In some examples, receiver unit 106A has a housing 222 that may contain some or all components of receiver unit 106A (e.g., processors 215, cable interface 216, receiver 218, and sensors 220). Housing 222 may be a standard shape or may be customized to fit a specific user's ear.

Storage device(s) 200 of BTE unit 104A include devices configured to store data. Such data may include computer-executable instructions, such as software instructions or firmware instructions. Storage device(s) 200 may include volatile memory and may therefore not retain stored contents if powered off. Examples of volatile memories may include random access memories (RAM), dynamic random access memories (DRAM), static random access memories (SRAM), and other forms of volatile memories known in the art. Storage device(s) 200 may further be configured for long-term storage of information as non-volatile memory space and retain information after power on/off cycles. Examples of non-volatile memory configurations may include flash memories, or forms of electrically programmable memories (EPROM) or electrically erasable and programmable (EEPROM) memories.

Wireless communication system 202 may enable BTE unit 104A to send data to and receive data from one or more other computing devices. For example, wireless communication system 202 may enable BTE unit 104A to send data to and receive data from hearing assistance device 102B. Wireless communication system 202 may use various types of wireless technology to communicate. For instance, wireless communication system 202 may use Bluetooth, 3G, 4G, 4G LTE, ZigBee, WiFi, Near-Field Magnetic Induction (NFMI), or another communication technology. In other examples, BTE unit 104A includes a wired communication system that enables BTE unit 104A to communicate with one or more other devices, such as hearing assistance device 102B, via a communication cable, such as a Universal Serial Bus (USB) cable or a Lightning™ cable.

Microphones 208 are configured to convert sound into electrical signals. Microphones 208 may include a front microphone and a rear microphone. The front microphone may be located closer to the front of the user. The rear microphone may be located closer to the rear of the user. In some examples, microphones 208 are included in receiver unit 106A instead of BTE unit 104A. In some examples, one or more of microphones 208 are included in BTE unit 104A and one or more of microphones 208 are included in receiver unit 106A. One or more of microphones 208 are omnidirectional microphones, directional microphones, or another type of microphones.

Processors 206 include circuitry configured to process information. BTE unit 104A may include various types of processors 206. For example, BTE unit 104A may include one or more microprocessors, digital signal processors, microcontroller units, and other types of circuitry for processing information. In some examples, one or more of processors 206 may retrieve and execute instructions stored in one or more of storage devices 200. The instructions may include software instructions, firmware instructions, or another type of computer-executed instructions. In accordance with the techniques of this disclosure, processors 206 may perform processes for adaptive binaural beamforming with preservation of spatial cues. In different examples of this disclosure, processors 206 may perform such processes fully or partly by executing such instructions, or fully or partly in hardware, or a combination of hardware and execution of instructions. In some examples, the processes for adaptive binaural beamforming with preservation of spatial cues are performed entirely or partly by processors of devices outside hearing assistance device 102A, such as by a smartphone or other mobile computing device.

In the example of FIG. 2, cable interface 212 is configured to connect BTE unit 104A to communication cable 108A. Communication cable 108A enables communication between BTE unit 104A and receiver unit 106B. For instance, cable interface 212 may include a set of pins configured to connect to wires of communication cable 108A. In some examples, cable interface 202 includes circuitry configured to convert signals received from communication channels 214 to signals suitable for transmission on communication cable 108A. Cable interface 212 may also include circuitry configured to convert signals received from communication cable 108A into signals suitable for use by components in BTE unit 104A, such as processors 206. In some examples, cable interface 212 is integrated into one or more of processors 206. Communication cable 108 may also enable BTE unit 104A to deliver electrical energy to receiver unit 106.

In some examples, communication cable 108A includes a plurality of wires. The wires may include a Vdd wire and a ground wire configured to provide electrical energy to receiver unit 106A. The wires may also include a serial data wire that carries data signals and a clock wire that carries a clock signal. For instance, the wires may implement an Inter-Integrated Circuit ($I^2C$ bus). Furthermore, in some examples, the wires of communication cable 108A may include receiver signal wires configured to carry electrical signals that may be converted by receiver 218 into sound.

In the example of FIG. 2, cable interface 216 of receiver unit 106A is configured to connect receiver unit 106A to communication cable 108A. For instance, cable interface 216 may include a set of pins configured to connect to wires of communication cable 108A. In some examples, cable interface 216 includes circuitry that converts signals received from communication cable 108A to signals suitable for use by processors 215, receiver 218, and/or other components of receiver unit 106A. In some examples, cable interface 216 includes circuitry that converts signals generated within receiver unit 106A (e.g., by processors 215, sensors 220, or other components of receiver unit 106A) into signals suitable for transmission on communication cable 108A.

Receiver 218 includes one or more speakers for generating sound. Receiver 218 is so named because receiver 218 is ultimately the component of hearing assistance device 102A that receives signals to be converted into soundwaves. In some examples, the speakers of receiver 218 include one or more woofers, tweeters, woofer-tweeters, or other specialized speakers for providing richer sound.

Receiver unit 106A may include various types of sensors 220. For instance, sensors 220 may include accelerometers, heartrate monitors, temperature sensors, and so on. Like processors 206, processors 215 include circuitry configured to process information. For example, receiver unit 106A may include one or more microprocessors, digital signal processors, microcontroller units, and other types of circuitry for processing information. In some examples, processors 215 may process signals from sensors 220. In some examples, processors 215 process the signals from sensors for transmission to BTE unit 104A. Signals from sensors 220 may be used for various purposes, such as evaluating a health status of a user of hearing assistance device 102A, determining an activity of a user (e.g., whether the user is in a moving car, running), and so on.

In other examples, hearing assistance devices 102 (FIG. 1) may be implemented as a BTE device in which components shown in receiver unit 106A are included in BTE unit 104A and a sound tube extends from receiver 218 into the user's ear.

Figure 3:
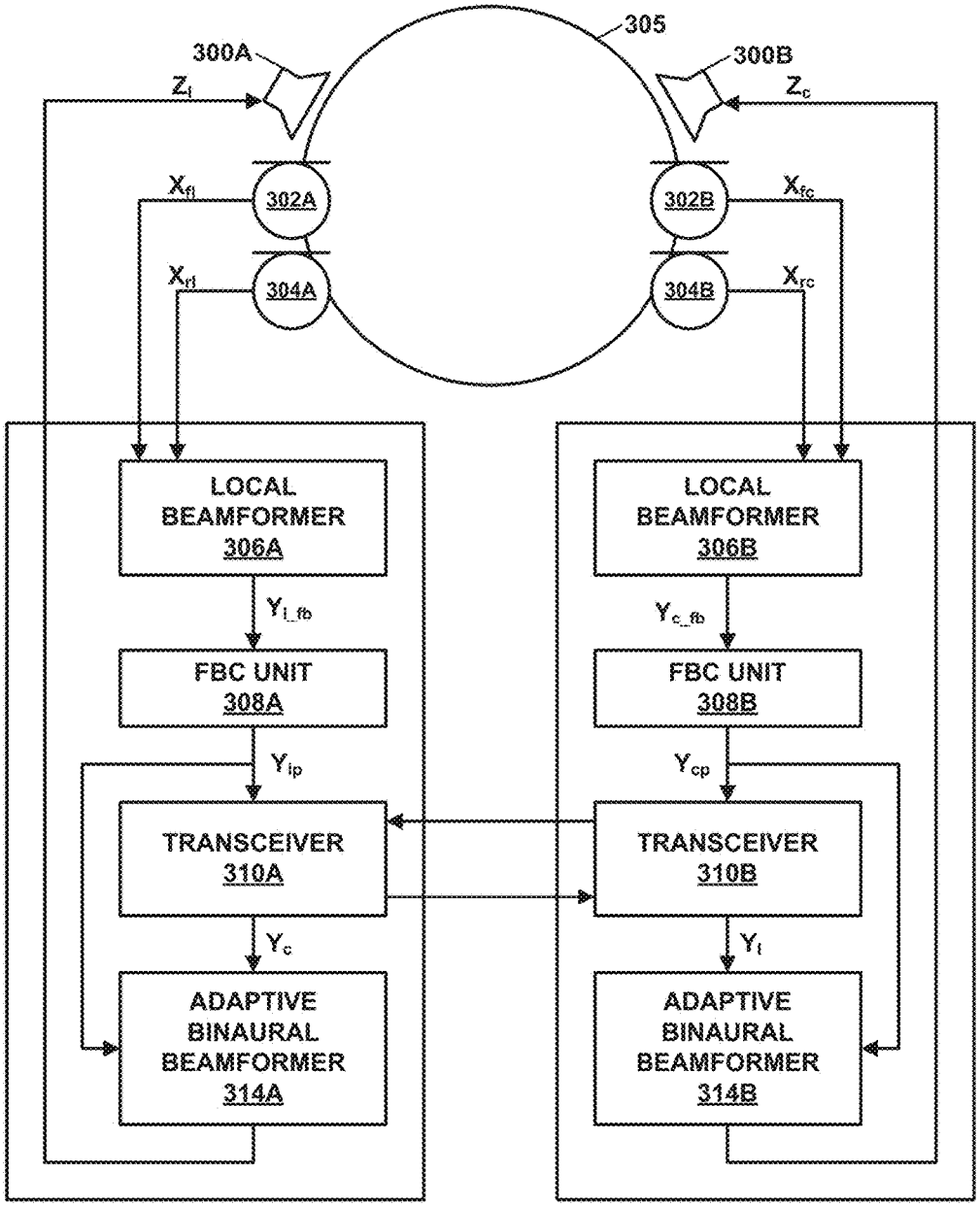
FIG. 3 is a block diagram illustrating an adaptive binaural beam forming system implemented in a hearing assistance system, in accordance with a technique of this disclosure.

FIG. 3 is a block diagram illustrating an adaptive binaural beam forming system implemented in hearing assistance system 100 (FIG. 1), in accordance with a technique of this disclosure. This disclosure describes FIG. 3 according to a convention in which hearing assistance device 102A is the "local" hearing assistance device and hearing assistance device 102B is the "contra" hearing assistance device. Hence, signals associated with the local hearing assistance device may be denoted with the subscript "l" and signals associated with the contra hearing assistance device may be denoted with the subscript "c."

In the example of FIG. 3, a receiver 300A of hearing assistance device 102A, a front local microphone 302A of hearing assistance device 102A, and a rear local microphone 304A of hearing assistance device 102A are located on one side of a user's head 305. Front local microphone 302A and rear local microphone 304A may be among microphones 208 (FIG. 2). Receiver 300A may be receiver 218 (FIG. 2). A receiver 300B of hearing assistance device 102B, a front contra microphone 302B of hearing assistance device 102B, and a rear contra microphone 304B of hearing assistance device 102B are located on an opposite side of the user's head 305.

Furthermore, in the example of FIG. 3, hearing assistance device 102A includes a local beamformer 306A, a feedback cancellation (FBC) unit 308A, a transceiver 310A, and an adaptive binaural beamformer 314A. Processors 206, processors 215 (FIG. 2), or other processors may implement local beamformer 306A, FBC unit 308A, and adaptive binaural beamformer 314A. In some examples, such processors may include dedicated circuitry for performing the functions of local beamformer 306A, FBC unit 308A, and adaptive binaural beamformer 314A, or the functions of these components may be implemented by execution of software by one or more of processors 206 and/or processors 215. Wireless communication system 202 (FIG. 2) may include transceiver 310A.

Hearing assistance device 102B includes a local beamformer 306B, a FBC unit 308B, a transceiver 310B, and an adaptive binaural beamformer 314B. Local beamformer 306B, FBC unit 308B, transceiver 310B, and adaptive binaural beamformer 314B may be implemented in hearing assistance device 102B in similar ways as local beamformer 306A, FBC unit 308A, transceiver 310A, and adaptive binaural beamformer 314A are implemented in hearing assistance device 102A. Although the example of FIG. 3 shows two microphones on either side of the user's head 305, a similar system may work with a single microphone on either side of the user's head 305. In such examples, local beamformers 306 may be omitted.

In the example of FIG. 3, local beamformer 306A receives a microphone signal ($X_{fl}$) from front local microphone 302A and a microphone signal ($X_{rl}$) from rear local microphone 304A. Local beamformer 306A combines microphone signal $X_{fl}$ and microphone signal $X_{rl}$ into a signal $Y_{l_fb}$. The signal $Y_{l_fb}$ is so named because it is a local signal that may include feedback (fb). An example implementation of a local beamformer, such as local beamformer 306A and local beamformer 306B is described below with reference to FIG. 14. Feedback may be present in microphone signals $X_{fl}$ and $X_{rl}$ because front local microphone 302A and/or rear local microphone 304A may receive soundwaves generated by receiver 300A and/or receiver 300B. Accordingly, in the example of FIG. 3, FBC unit 308A cancels the feedback in signal $Y_{l_fb}$, resulting in signal $Y_{lp}$. Signal $Y_{lp}$ is so named because it is a local (l) signal that has been processed (p). FBC unit 308A may be implemented in various ways. For instance, in one example, FBC unit 308A may apply a notch filter that attenuates a system response over frequency regions where feedback is most likely to occur. In some examples, FBC unit 308A may use an adaptive feedback cancelation system. Kates, "Digital Hearing Aids," Plural Publishing (2008), pp. 113-145, describes various feedback cancelation systems.

Transceiver 310A of hearing assistance device 102A may transmit a version of signal $Y_{lp}$ to transceiver 310B of hearing assistance device 102B. Adaptive binaural beamformer 314B may generate an output signal $Z_c$ based in part on a signal $Y_l$ and a signal $Y_{cp}$. Signal $Y_l$ is, or is based on, signal $Y_{lp}$ generated by FBC unit 308A. Signal $Y_l$ may differ from signal $Y_{lp}$ because of resampling, audio coding, transmission errors, and other intentional or unintentional alterations of signal $Y_{lp}$. Thus, in some examples, the version of signal $Y_{lp}$ that transceiver 310A transmits to transceiver 310B is not the same as signal $Y_{lp}$.

Similarly, local beamformer 306B receives a microphone signal ($X_{fc}$) from front contra microphone 302B and a microphone signal ($X_{rc}$) from rear contra microphone 304B. Local beamformer 306B combines microphone signal $X_{fc}$ and microphone signal $X_{rc}$ into a signal $Y_{c_fb}$. Local beamformer 306B may generate signal $Y_{c_fb}$ in a manner similar to how local beamformer 306A generates signal $Y_{l_fb}$. The signal $Y_{c_fb}$ is so named because it is a contra signal that may include feedback (fb). Feedback may be present in microphone signals $X_{fc}$ and $X_{rc}$ because front contra microphone 302B and/or rear contra microphone 304B may receive soundwaves generated by receiver 300B and/or receiver 300A. Accordingly, in the example of FIG. 3, FBC unit 308B cancels the feedback in signal $Y_{c_fb}$, resulting in signal $Y_{cp}$. Signal $Y_{cp}$ is so named because it is a contra (c) signal that has been processed (p). Transceiver 310B of hearing assistance device 102B may transmit a version of signal $Y_{cp}$ to transceiver 310A of hearing assistance device 102A. Adaptive binaural beamformer 314A may generate an output signal $Z_l$ based on signal $Y_{lp}$ and a signal $Y_c$. Signal $Y_c$ is or is based on signal $Y_{cp}$ generated by FBC unit 308B. Signal $Y_c$ may differ from signal $Y_{cp}$ because of resampling, audio coding, transmission errors, and other intentional or unintentional alterations of signal $Y_{cp}$. Thus, in some examples, the version of signal $Y_{cp}$ that transceiver 310B transmits to transceiver 310A is not the same as signal $Y_c$.

As noted above, adaptive binaural beamformer (ABB) 314A generates an output audio signal $Z_l$. Signal $Z_l$ may be used to drive receiver 300A. In other words, receiver 300A may generate soundwaves based on output audio signal $Z_l$. In accordance, with a technique of this disclosure, ABB 314A may calculate signal $Z_l$ as:

$$Z_l=V_lY_l-\alpha_l(V_lY_l-V_cY_c)=Y_{lv}-\alpha_l(Y_{lv}-Y_{cv})$$

$$Z_l=Y_{lv}-\alpha_lY_{diff}\text{where } Y_{diff}=(Y_{lv}-Y_{cv}) \quad (1)$$

In the equations above, $V_l$ and $V_c$ are local and contra correction factors. $\alpha_l$ is a local parameter.

Correction factors $V_l$ and $V_c$ may ensure that target signals (e.g., sound radiated from a single source at the same instant) in the two signals $Y_l$ and $Y_c$ are aligned (e.g., in terms of time, amplitude, etc.). Correction factors $V_l$ and $V_c$ can align differences due to microphone sensitivity (e.g., amplitude and phase), wireless transmission (e.g., amplitude and phase/delay), target position (e.g., in case the target (i.e., the source of a sound that the user wants to listen to) is not positioned immediately in front of the user).

Correction factors $V_l$ and $V_c$ may be set as parameters within devices 102 or estimated online by a remote processor and downloaded to one or both of the devices. For example, a technician or other person may set $V_l$ and $V_c$ when a user of hearing assistance system 100 is fitted with hearing assistance devices 102. In some examples, $V_l$ and $V_c$ may be determined by hearing assistance devices 102 dynamically. For instance, hearing assistance system 100 may estimate $V_l$ and $V_c$ by determining values of $V_l$ and $V_c$ that maximize the energy of the signal $V_lY_l+V_cY_c$ while constraining the norm $|V_l|+|V_c|=1$, where $|\bullet|$ indicates the norm operator. In some examples, both $V_l$ and $V_c$ are in unity. In other words, $V_l$ and $V_c$ may have the same value. In other examples, $V_l$ and $V_c$ have different values.

ABB 314A and ABB 314B may be similar to a Generalized Sidelobe Canceller (GSC), as described in Doclo, S. et al "Handbook on array processing and sensor networks," pp. 269-302. To avoid self-cancellation and to maintain spatial impression, the parameter $\alpha_l$ is restricted to be a real parameter between 0 and ½. The value $\alpha_l=0$ corresponds to the bilateral solution and $\alpha_l=½$ corresponds to the static binaural beamformer. The restriction on $\alpha_l$ also limits the self-cancellation. If $\alpha_l=½$ and $Y_{diff}$ is 10 dB below $Y_{lv}$, the self-cancellation is db(1−0.5*0.3)=−1.4 dB. It would be possible to correct for this self-cancellation by scaling $V_l$ and $V_c$. The solution is limited to $\alpha_l<=½$, because solutions with $\alpha_l>½$ correspond to solutions that use the contra-signal more than the $Y_{lv}$ signal and this would result in an odd spatial perception (sources from the left seem to come from the right and vice versa).

Figure 4:
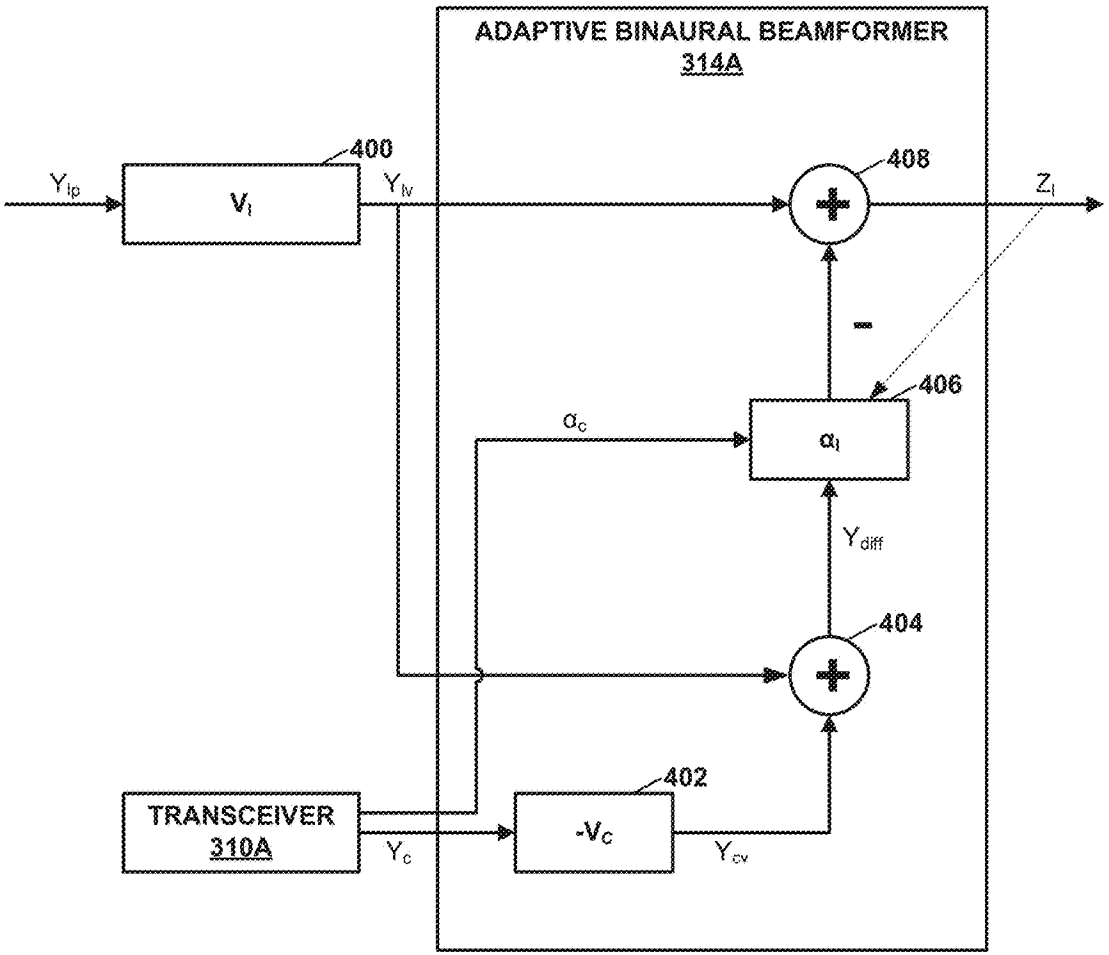
FIG. 4 is a conceptual diagram of a first exemplary implementation of an adaptive binaural beamformer, in accordance with one or more techniques of this disclosure.

FIG. 4 is a conceptual diagram of a first exemplary implementation of adaptive binaural beamformer 314A, in accordance with one or more techniques of this disclosure. Adaptive binaural beamformer 314B (FIG. 3) may be implemented in a similar way, switching the "l" and "c" denotations in the subscripts of signals in FIG. 3.

In the example of FIG. 4, hearing assistance device 102A includes a correction unit 400 that applies a correction factor $V_l$ to a signal $Y_l$ in order to generate signal $Y_{lv}$. For instance, correction unit 400 may multiply each sample value of signal $Y_l$ by correction factor $V_l$ in order to generate signal $Y_{lv}$. In some examples, signal $Y_l$ is identical to the signal $Y_{lp}$ generated by FBC unit 308A (FIG. 3). In other examples, signal $Y_l$ is different from signal $Y_{lp}$ in one or more respects. For instance, signal $Y_l$ may be a downsampled, upsampled, and/or quantized version of signal $Y_{lp}$. ABB 314A obtains the signal $Y_{lv}$ generated by correction unit 400. Furthermore, in the example of FIG. 4, ABB 314A obtains a value of a contra parameter (ac) and signal $Y_c$ from transceiver 310A.

In the example of FIG. 4, correction unit 402 applies correction factor $-V_c$ to signal $Y_c$ in order to generate signal $Y_{cv}$. For instance, correction unit 402 may multiply each sample value of signal $Y_c$ by correction factor $-V_c$ in order to generate signal $Y_{cv}$. Furthermore, a combiner unit 404 of ABB 314A combines signals $Y_{lv}$ and $Y_{cv}$. For instance, combiner unit 404 may add each sample of $Y_{lv}$ to a corresponding sample of $Y_{cv}$. Because correction unit 402 multiplied signal $Y_c$ by a negative value (i.e., $-V_c$), adding each sample of $Y_{lv}$ to a corresponding sample of $Y_{cv}$ is equivalent to $Y_{lv}-Y_{cv}$ (i.e., signal $Y_{diff}$). Additionally, in the example of FIG. 4, unit 406 of ABB 314A multiplies signal $Y_{diff}$ by local parameter $\alpha_l$.

As described in detail elsewhere in this disclosure, ABB 314A may determine the value of $\alpha_l$ based on contra parameter $\alpha_c$ and a signal $Z_l$. Signal $Z_l$ is a signal generated by ABB 314A, but may not necessarily be the final version of signal $Z_l$ generated by ABB 314A based on signals $Y_{lv}$ and $Y_c$. Rather, the final version of signal $Z_l$ generated by ABB 314A based on signals $Y_{lv}$ and $Y_c$ may instead be the version of signal $Z_l$ generated based on a final value of $\alpha_l$. This disclosure may refer to non-final versions of signal $Z_l$ as candidate audio signals.

A combiner unit 408 may combine signals $Y_{lv}$ and $-\alpha_lY_{diff}$ to generate signal $Z_l$. For instance, combiner unit 408 may add each sample of signal $Y_{lv}$ to a corresponding signal of $-\alpha_l Y_{diff}$ to generate samples of signal $Z_l$. In this way, ABB 314A may determine $Z_l = Y_{lv} - \alpha_l Y_{diff}$.

As mentioned above, ABB 314A may determine a value of $\alpha_l$ based on contra parameter $\alpha_c$ and signal $Z_l$. ABB 314A may use various techniques to determine the value of $\alpha_l$. In one example, ABB 314A performs an iterative optimization process that performs a set of steps one or more times. During the optimization process, ABB 314A seeks to minimize an output value of a cost function. Input values of the cost function may include a local candidate audio signal $Z_l$ based on a value of $\alpha_l$. During each iteration of the optimization process, ABB 314A determines an output value of the cost function based on local candidate audio signals $Z_l$ that are based on different values of $\alpha_l$.

In one example, the output value of the cost function is an output power of the local candidate audio signal $Z_l$. In other words, an error criterium of the minimization problem may be the output power. In this example, the following equation defines the cost function:

$$J_l = Z_l Z_l^* \tag{2}$$

In equation (2) above, $J_l$ is the output value of the cost function, $Z_l$ is the local candidate audio signal and $Z_l^*$ is the conjugate transpose of $Z_l$. Note that since $Z_l$ is defined based on $\alpha_l$ as shown in equation (1), the cost function defined in equation (2) is based on local parameter $\alpha_l$. Hearing aid algorithms usually operate in the sub-band or frequency domain. This means that a block of time-domain signals is transformed to the sub-band or frequency domain using a filter bank (such as an FFT).

During an iteration of the optimization process, ABB 314A may modify the value of local parameter $\alpha_l$ in a direction of decreasing output values of the cost function. For instance, ABB 314A may increment or decrement the value of local parameter $\alpha_l$ in the direction of decreasing output values of the cost function. For example, if the direction of decreasing output values of the cost function is associated with lower values of local parameter $\alpha_l$, ABB 314A may decrease the value of local parameter $\alpha_l$. Conversely, if the direction of decreasing output values of the cost function is associated with higher values of local parameter $\alpha_l$, ABB 314A may increase the value of local parameter $\alpha_l$.

Unit 406 may determine the direction of decreasing output values of the cost function in various ways. For instance, in an example where unit 406 uses equation (2) as the cost function, ABB 314A may determine a derivative of equation (2) with respect to local parameter $\alpha_l$. With the restriction of the local parameter $\alpha_l$ to real values, the derivative of equation (2) with respect to local parameter $\alpha_l$ may be defined as shown in equations (3), below:

$$\begin{aligned}\frac{\partial J_l}{\partial \alpha_l} &= Z_l \frac{\partial Z_l^*}{\partial \alpha_l} + Z_l^* \frac{\partial Z_l}{\partial \alpha_l} \\ &= -Z_l Y_{diff}^* - Z_l^* Y_{diff} \\ &= -(Y_{lv} - \alpha_l Y_{diff}) Y_{diff}^* - (Y_{lv} - \alpha_l Y_{diff})^* Y_{diff} \\ &= 2\alpha_l Y_{diff} Y_{diff}^* - Y_{lv} Y_{diff}^* - Y_{lv}^* Y_{diff} \\ &= 2\alpha_l Y_{diff} Y_{diff}^* - 2Re(Y_{lv} Y_{diff}^*)\end{aligned} \tag{3}$$

In equations (3), $Re(Y_{lv} Y_{diff}^*)$ indicates the real part of signal $Y_{lv} Y_{diff}^*$. When using equations (3) to determine a gradient of the cost function for a particular value of the local parameter $\alpha_l$, the number of multiplications may be limited to 6.

In some examples, ABB 314A normalizes the amounts by which ABB 314A modifies the value of local parameter $\alpha_l$ by dividing the gradient by the power of $Y_{diff}$. For instance, ABB 314A may calculate a modified value of local parameter $\alpha_l$ as shown in equation (4), below.

$$\alpha_l(n+1) = \alpha_l(n) + \frac{\mu e^*(n) x(n)}{x^H(n) x(n)} \tag{4}$$

In equation (4), $\alpha_l(n+1)$ is the modified value of local parameter $\alpha_l$ for frame (n+1), $\alpha_l(n)$ is a current value of local parameter $\alpha_l$ for block n, n is an index for frames, $\mu$ is a parameter that controls a rate of adaptation, e*(n) is the complex conjugate of $Z_l$ for frame n, x(n) is the portion of $Y_{diff}$ for frame n, and $x^H(n)$ is the Hermitian transpose of x(n). A frame may be a set of time-consecutive audio samples, such as a set of audio samples corresponding to a fixed length of playback time.

If the optimization process were to end after ABB 314A determines the value of local parameter $\alpha_l$ associated with a lowest output value of the cost function, ABB 314A may still eliminate binaural cues and the listener may not have a good spatial impression. This may result in an unfavorable user impression of the beamformer. However, techniques of this disclosure may overcome this deficiency.

Figure 5A:
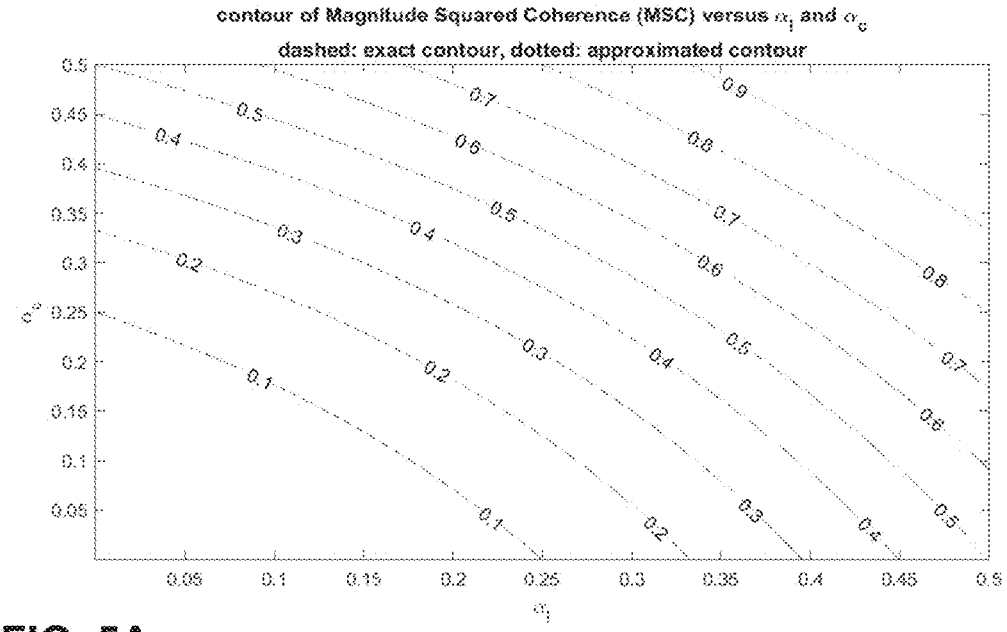
FIG. 5A illustrates example magnitude squared coherence of $Z_l$ and $Z_c$ as a function of local parameter $\alpha_l$ and contra parameter $\alpha_c$.

Particularly, it is noted that one metric for the spatial impression of the solution is the magnitude squared coherence (MSC) of $Z_l$ and $Z_c$. FIG. 5A illustrates example magnitude squared coherence of $Z_l$ and $Z_c$ as a function of local parameter $\alpha_l$ and contra parameter $\alpha_c$. Particularly, FIG. 5A shows the Magnitude Squared Coherence ($MSC = IC_{out}^2$) of $Z_l$ and $Z_c$ as a function of $\alpha_l$ and $\alpha_c$ and shows that the contour of the MSC can be modeled with the following equation:

$$\alpha_l + \alpha_c - \delta_{msc} \alpha_l \alpha_c = \gamma_{msc} \tag{5}$$

In equation (5), $\delta_{msc}$ and $\gamma_{msc}$ depend on the MSC of $Z_l$ and $Z_c$. In the example of FIG. 5A, $\delta_{msc}$ is set to 1 and $\gamma_{msc}$ is set to a given MSC level (i.e., a coherence threshold). For instance, in FIG. 5A, the line $\alpha_l + \alpha_c - \alpha_l \alpha_c = 0.5$ represents the line where MSC of $Z_l$ and $Z_c$ is 0.5.

The MSC of $Z_l$ and $Z_c$ may be calculated as follows:

$$MSC = \frac{(\alpha_l + \alpha_c - 2\alpha_l \alpha_c)^2}{(1 - 2\alpha_l + 2\alpha_l^2)(1 - 2\alpha_c + 2\alpha_c^2)} \tag{6}$$

Figure 5B:
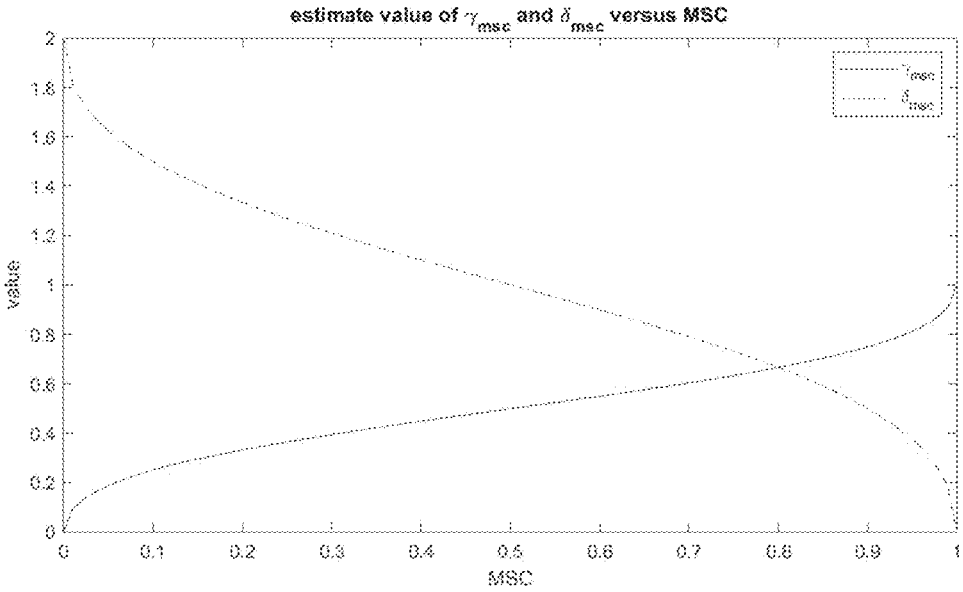
FIG. 5B illustrates example estimated values of $\gamma_{msc}$ and $\delta_{msc}$.

Furthermore, equation (5) (i.e., $\alpha_l + \alpha_c - \delta_{msc} \alpha_l \alpha_c = \gamma_{msc}$) can be rewritten into the format Ax=b, where $A = [\alpha_l \alpha_c \ 1]$, $x = [\delta_{msc} \gamma_{msc}]^T$, and $b = [\alpha_l + \alpha_c]$. Since there are multiple pairs ($N_{pair}$) of values for $\alpha_l$ and $\alpha_c$, A is a $N_{pair}$x2 matrix and b is a $N_{pair}$x1 vector. Ax=b may be solved using $x = (A^T A)^{-1} b$, where T is the transpose of a matrix and −1 is the inverse. Thus, $\delta_{msc}$ and $\gamma_{msc}$ are defined based on the coherence threshold (i.e., the given MSC level). FIG. 5B illustrates example estimated values of $\gamma_{msc}$ and $\delta_{msc}$.

Equation (5) can be used to constrain the MSC of $Z_l$ and $Z_c$ so that the listener may have a good spatial impression. In other words, ABB 314A may constrain $\gamma_{msc}$ such that $\gamma_{msc}$ is less than a threshold value (i.e., a coherence threshold) for the MSC of $Z_l$ and $Z_c$. Keeping the MSC of $Z_l$ and $Z_c$ below the coherence threshold for the MSC of $Z_l$ and $Z_c$ prevents $Z_l$ and $Z_c$ from being so similar that the user is unable to perceive spatial cues from the differences between $Z_l$ and $Z_c$.

Because the MSC of $Z_l$ and $Z_c$ is limited, hearing assistance devices 102 may be said to implement coherence-limited binaural beamformers.

The coherence threshold for the MSC of $Z_l$ and $Z_c$ may be predetermined or may depend on user preferences or environmental conditions. For instance, there is evidence that some hearing-impaired users are better able than others to use interaural differences to improve speech recognition in noise. Those hearing-impaired users may be better served by constraining the MSC of $Z_l$ and $Z_c$ to a relatively low coherence threshold. Users who cannot use these differences may be better served by not constraining the MSC of $Z_l$ and $Z_c$. In some examples, the coherence threshold for the MSC of $Z_l$ and $Z_c$ depends on the environmental conditions (e.g., in addition to or as an alternative to user preferences). For instance, in a restaurant, a user might want to maximize the understanding of speech and therefore want no constraint on the MSC of $Z_l$ and $Z_c$. Thus, hearing assistance devices 102 may set the coherence threshold for the MSC of $Z_l$ and $Z_c$ to a relatively high value, such as a value close to 1. This preference might be listener-dependent. For instance, some users with more hearing loss prefer stronger binaural processing. However, when a user is in traffic or a car, spatial awareness might be more important to the user; therefore hearing assistance devices 102 may constrain the MSC of $Z_l$ and $Z_c$ to a lower coherence threshold (e.g., a coherence threshold closer to 0).

In one example, ABB 314A may constrain the MSC of $Z_l$ and $Z_c$ by scaling the values of $\alpha_l$ and $\alpha_c$ with a scaling factor c after each iteration of the optimization process so that the following constraint to $\gamma_{msc}$ is met:

$$c\alpha_l + c\alpha_c - c^2\delta_{msc}\alpha_l\alpha_c = \gamma_{msc} \tag{7}$$

In this example, the scaling factor c is a number between 0 and 1.

ABB 314A may calculate the value for scaling factor c with the following quadratic equation:

$$c = \frac{-(\alpha_l + \alpha_c) \pm \sqrt{(\alpha_l + \alpha_c)^2 - 4\delta_{MSC}\alpha_l\alpha_c\gamma_{MSC}}}{-2\delta_{MSC}\alpha_l\alpha_c} \tag{8}$$

In this example, because one of the solutions of equation (8) does not meet the requirement of scaling factor c being between 0 and 1, and that solution can be discarded. Hence, ABB 314A may calculate the value of scaling factor c using the following equation:

$$c = \frac{(\alpha_l + \alpha_c) - \sqrt{(\alpha_l + \alpha_c)^2 - 4\delta_{msc}\alpha_l\alpha_c\gamma_{msc}}}{2\delta_{msc}\alpha_l\alpha_c} \tag{9}$$

In this way, ABB 314A may determine a scaling factor c based on the modified value of the local parameter $\alpha_l$, the value of the contra parameter $\alpha_c$, and a coherence threshold ($\gamma_{msc}$). The coherence threshold is a maximum allowed coherence of the output audio signal $Z_l$ for the local device and an output audio signal ($Z_c$) for the contra device.

Furthermore, ABB 314A may set the value of the local parameter $\alpha_l$ based on the modified value of the local parameter $\alpha_l$ scaled by the scaling factor c. For instance, ABB 314A may set the value of local parameter $\alpha_l$ as shown in the following equation:

$$\alpha_l = \alpha_l \cdot c \tag{10}$$

ABB 314A may repeat the optimization process using this newly set value of the local parameter $\alpha_l$ (e.g., for a next frame of $Y_{diff}$). That is, ABB 314A may determine a scaled difference signal based on the difference signal scaled by the newly set value of local parameter $\alpha_l$, generate a local candidate audio signal based on a difference between the local preliminary audio signal and the scaled difference signal, and so on.

Because the scaling factor c depends on contra parameter $\alpha_c$, each of hearing assistance devices 102 sends values of the local parameter $\alpha_l$ to the other hearing assistance device. The hearing assistance device uses the value received by the hearing assistance device from the other hearing assistance device as the contra parameter $\alpha_c$. However, the value of $\alpha_l$ (or $\alpha_c$) can be transmitted in a sub-sampled discretized manner.

As mentioned above, ABB 314A may constrain the MSC of $Z_l$ and $Z_c$. The MSC of $Z_l$ and $Z_c$ may be determined as follows. First, the output coherence of hearing assistance devices 102 with output $Z_l$ and $Z_c$ and parameters $\alpha_l$ and $\alpha_c$ can be calculated as follows:

$$IC_{out} = \frac{\varepsilon\{Z_l Z_c^*\}}{\sqrt{\varepsilon\{Z_l Z_l^*\}\varepsilon\{Z_c Z_c^*\}}} \tag{11}$$

In equation (11) above and throughout this disclosure, $\varepsilon\{\bullet\}$ denotes the expectation operator, and $IC_{out}$ is the output coherence of output $Z_l$ and $Z_c$, $Z_c^*$ is the conjugate transpose of $Z_c$.

The terms in the numerator and denominator of equation (11) can be extended to $$\begin{aligned}\varepsilon\{Z_l Z_c^*\} &= \varepsilon\{((1-\alpha_l)Y_{lv} + \alpha_l Y_{cv})((1-\alpha_c)Y_{cv} + \alpha_c Y_{lv})^*\} \\ &= (1-\alpha_l)\alpha_c\varepsilon\{Y_{lv}Y_{lv}^*\} + \alpha_l(1-\alpha_c)\varepsilon\{Y_{cv}Y_{cv}^*\} + \\ &\quad (1-\alpha_l)^2\varepsilon\{Y_{lv}Y_{cv}^*\} + \alpha_l\alpha_c\varepsilon\{Y_{cv}Y_{lv}^*\}\end{aligned} \tag{12}$$

and $$\begin{aligned}\varepsilon\{Z_l Z_c^*\} &= \varepsilon\{((1-\alpha_l)Y_{lv} + \alpha_l Y_{cv})((1-\alpha_c)Y_{lv} + \alpha_l Y_{cv})^*\} \\ &= (1-\alpha_l)^2\varepsilon\{Y_{lv}Y_{lv}^*\} + (1-\alpha_l)\alpha_l\varepsilon\{Y_{lv}Y_{cv}^*\} + \\ &\quad \alpha_l(1-\alpha_l)\varepsilon\{Y_{cv}Y_{lv}^*\} + \alpha_l^2\varepsilon\{Y_{cv}Y_{cv}^*\}\end{aligned}$$

If hearing assistance devices 102 are in a diffuse noise field, the signals at both hearing assistance devices 102 have the same power and are uncorrelated:

$$\varepsilon\{Y_{lv}Y_{lv}^*\} = \varepsilon\{Y_{cv}Y_{cv}^*\} = \varepsilon\{YY^*\}$$

$$\varepsilon\{Y_{lv}Y_{cv}^*\} = \varepsilon\{Y_{cv}Y_{lv}^*\} = 0 \tag{13}$$

In equation (11), $\varepsilon\{YY^*\}$ is the power of the diffuse noise field. The diffuse noise field has the same power at the left and right ear.

This results in:

$$\begin{aligned}\varepsilon\{Z_l Z_c^*\} &= (1-\alpha_l)\alpha_c\varepsilon\{Y_{lv}Y_{lv}^*\} + \alpha_l(1-a_c)\varepsilon\{Y_{cv}Y_{cv}^*\} + \\ &\quad (1-\alpha_l)^2\varepsilon\{Y_{lv}Y_{cv}^*\} + \alpha_l\alpha_c\varepsilon\{Y_{cv}Y_{lv}^*\} \\ &= (1-\alpha_l)a_c\varepsilon\{YY^*\} + \alpha_l(1-\alpha_c)\varepsilon\{YY^*\} \\ &= (\alpha_l + \alpha_c - 2\alpha_l\alpha_c)\varepsilon\{YY^*\}\end{aligned} \tag{14}$$

and

-continued $$\begin{aligned}\varepsilon\{Z_l Z_c^*\} &= (1-\alpha_l)^2\varepsilon\{Y_{lv}Y_{lv}^*\} + (1-a_l)\alpha_l\varepsilon\{Y_{lv}Y_{cv}^*\} + \\ &\quad \alpha_l(1-\alpha_l)\varepsilon\{Y_{cv}Y_{lv}^*\} + \alpha_l^2\varepsilon\{Y_{cv}Y_{lv}^*\} \\ &= (1-\alpha_l)^2\varepsilon\{YY^*\} + \alpha_l^2\varepsilon\{YY^*\} \\ &= (1-2\alpha_l+2\alpha_l^2)\varepsilon\{YY^*\}\end{aligned}$$

The interaural coherence is:

$$IC_{out} = \frac{\alpha_l + \alpha_c - 2\alpha_l\alpha_c}{\sqrt{(1-2\alpha_l+2\alpha_l^2)(1-2\alpha_c+2\alpha_c^2)}} \tag{15}$$

If $\alpha_l=\alpha_c=0$, $IC_{out}=0$ and if $\alpha_l=\alpha_c=½$, $IC_{out}=1$, which is as expected.

Figure 6:
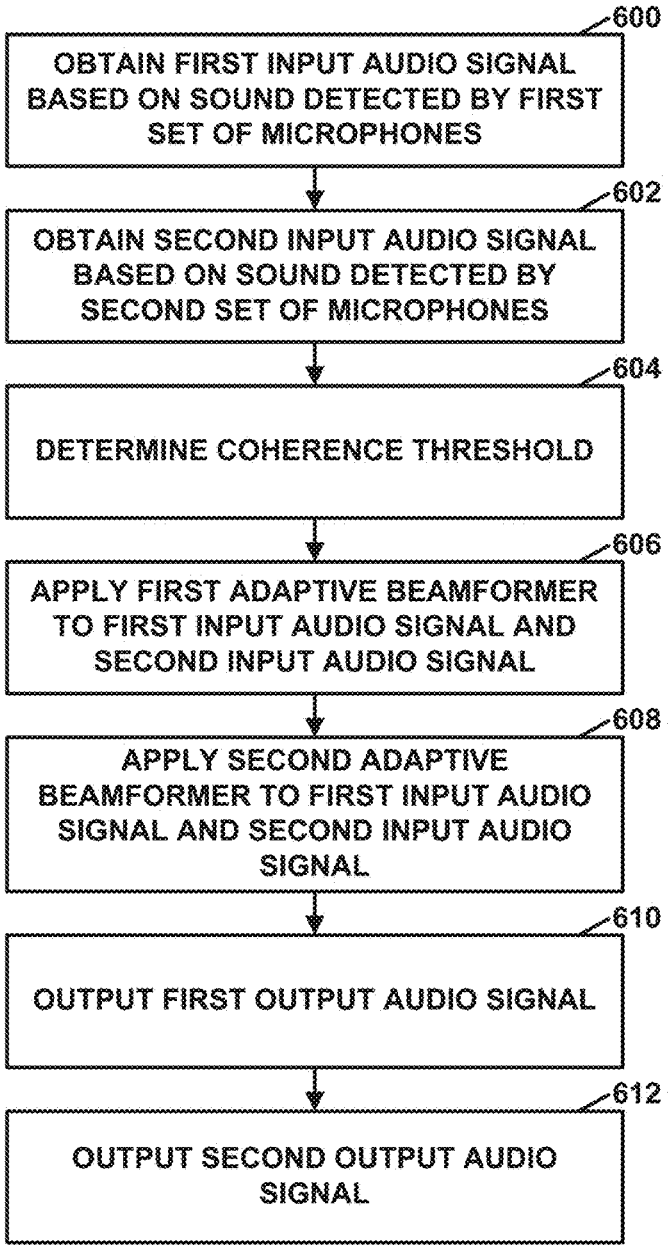
FIG. 6 is a flowchart illustrating an example operation of a hearing assistance system, in accordance with one or more techniques of this disclosure.

FIG. 6 is a flowchart illustrating an example operation of a hearing assistance system, in accordance with one or more techniques of this disclosure. The flowcharts of this disclosure are provided as examples. In other examples, operations shown in the flowcharts may include more, fewer, or different actions, or actions may be performed in different orders or in parallel.

In the example of FIG. 6, hearing assistance system 100 obtains a first input audio signal that is based on sound received by a first set of microphones associated with a first hearing assistance device (600). Hearing assistance system 100 may obtain the first input audio signal in various ways. For example, local beamformer 306A (FIG. 3) and FBC unit 308A may generate the first input audio signal based on signals $X_{fl}$ and $X_{rl}$ from microphones 302A and 304A (i.e., a first set of microphones), as described elsewhere in this disclosure. In another example, there is only a single microphone on each side of the user's head 305. In this example, FBC unit 308A may generate the first input audio signal based on a signal from one of the microphones. In some examples, as part of obtaining the first input audio signal, hearing assistance system 100 may scale an audio signal ($Y_l$) by a correction factor ($V_l$) to derive the first input audio signal ($Y_{lv}$), as described above in equation (1).

Furthermore, in the example of FIG. 6, hearing assistance system 100 obtains a second input audio signal that is based on sound received by a second, different set of microphones (i.e., different than the first set of microphones) that are associated with a second hearing assistance device (602). In some examples, the first and second sets of microphones may share no common microphone. In some examples, the first and second sets of microphones have one or more microphones in common and one or more microphones not in common. The first and second hearing assistance devices may be wearable concurrently on different ears of a same user. For instance, the first hearing assistance device may be hearing assistance device 102A and the second hearing assistance device may be hearing assistance device 102B. Hearing assistance system 100 may obtain the second input audio signal in various ways. For example, local beamformer 306B (FIG. 3) and FBC unit 308B may generate the second input audio signal based on signals $X_{fc}$ and $X_{rc}$ from microphones 302B and 304B (i.e., a second set of microphones), as described elsewhere in this disclosure. In another example, there is only a single microphone on each side of the user's head 305. In this example, FBC unit 308B may generate the second input audio signal based on a signal from one of the microphones. In some examples, as part of obtaining the second input audio signal, hearing assistance system 100 may scale an audio signal ($Y_c$) by a correction factor ($V_c$) to derive the second input audio signal ($Y_{cv}$), as described above in equation (1).

In the example of FIG. 6, hearing assistance system 100 may determine a coherence threshold (604). In some examples, the coherence threshold is a fixed, predetermined value. In such examples, determining the coherence threshold may involve reading a value of the coherence threshold from a memory or other computer-readable storage medium. In some examples, either or both of hearing assistance devices 102 may determine the coherence threshold adaptively or based on user preferences. For instance, as described elsewhere in this disclosure, if the user is using hearing assistance system 100 while driving in a car, hearing assistance system 100 may determine a lower coherence threshold than in other situations. In some examples, the coherence value may be customized to a user's preferences. For instance, users with more profound hearing loss may prefer more binaural processing. Accordingly, in this example, hearing assistance system 100 may determine a lower coherence threshold for a user with more profound hearing loss than a user with less profound hearing loss.

Hearing assistance system 100 may apply a first adaptive beamformer to the first input audio signal and the second input audio signal (606). The first adaptive beamformer generates a first output audio signal based on the first input audio signal, the second input audio signal, and a value of a first parameter (e.g., $\alpha_l$). Additionally, hearing assistance system 100 may apply a second adaptive beamformer to the first input audio signal and the second input audio signal (608). The second adaptive beamformer generates a second output audio signal based on the first input audio signal, the second input audio signal, and a value of a second parameter (e.g., $\alpha_c$). Hearing assistance system 100 determines the value of the first parameter and the value of the second parameter such that a magnitude squared coherence (MSC) of the first output audio signal and the second output audio signal is less than or equal to the coherence threshold. Hearing assistance system 100 may apply the first adaptive beamformer and the second adaptive beamformer in various ways. For instance, hearing assistance system 100 may apply an adaptive beamformer of the type described with respect to FIG. 4, FIG. 7, and FIG. 8, and in accordance with examples provided elsewhere in this disclosure.

Furthermore, in the example of FIG. 6, the first hearing assistance device may output the first output audio signal (610). For instance, receiver unit 106A of hearing assistance device 102A may generate sound based on the first output audio signal. The second hearing assistance device may output the second output audio signal (612). For instance, receiver unit 106B of hearing assistance device 102B may generate sound based on the second output audio signal.

Figure 7:
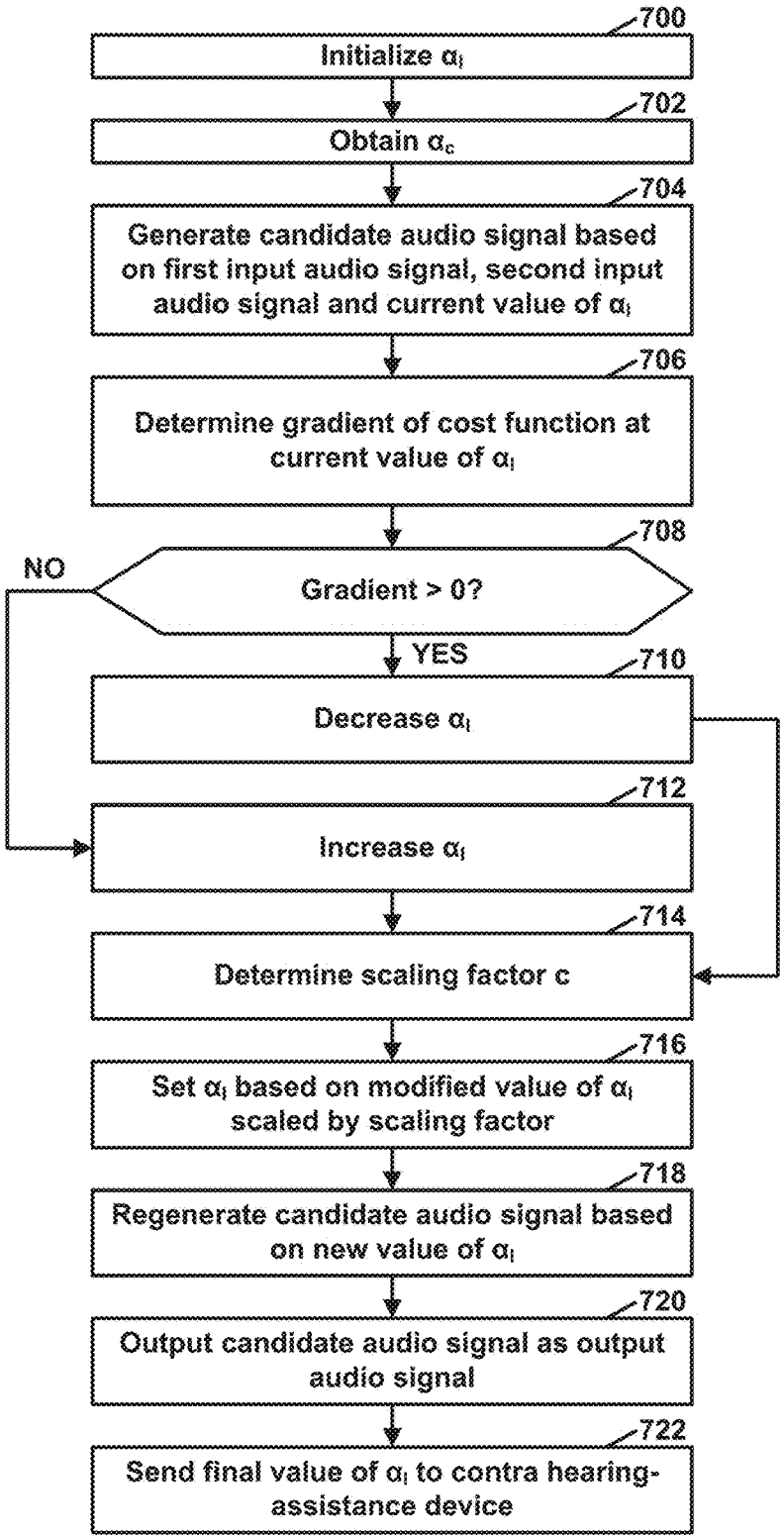
FIG. 7 is a flowchart illustrating an example operation of an adaptive binaural beamformer, in accordance with a technique of this disclosure.

FIG. 7 is a flowchart illustrating an example operation of an adaptive binaural beamformer, in accordance with a technique of this disclosure. Although this disclosure describes the example of FIG. 7 with reference to ABB 314A, ABB 314B may perform the operation of FIG. 7 in parallel with ABB 314A. For instance, a left hearing assistance device may implement ABB 314A and a right hearing assistance device may implement ABB 314B. Thus, for ABB 314A, $\alpha_l$ is local to the left hearing assistance device; for ABB 314B, $\alpha_l$ is local to the right hearing assistance device. For ABB 314A, $\alpha_c$ is obtained from the right hearing assistance device; for ABB 314B, $\alpha_c$ is obtained from the left hearing assistance device. For ABB 314A, the output audio signal $Z_l$ is the output audio signal for the left hearing assistance device; for ABB 314B, the output audio signal $Z_l$ is the output audio signal of the right hearing assistance device.

In the example of FIG. 7, ABB 314A may initialize $\alpha_l$ (700). ABB 314A may initialize $\alpha_l$ in various ways. For example, because $\alpha_l$ is in the range of 0 to 0.5, ABB 314A may initialize $\alpha_l$ to 0.25. In another example, ABB 314A may initialize $\alpha_l$ based on a value of $\alpha_l$ used in a previous frame. For instance, ABB 314A may initialize $\alpha_l$ such that $\alpha_l$ is equal to a value of $\alpha_l$ used in a previous frame, equal to an average of values used in a series of two or more previous frames, or otherwise initialize $\alpha_l$ based on values of $\alpha_l$ used in one or more previous frames. In some examples where ABB 314A initialize $\alpha_l$ to a value of $\alpha_l$ used in a previous frame, the value of $\alpha_l$ tends to stabilize within a short period of time (e.g., a few seconds). Accordingly, in such examples, it may not be necessary for ABB 314A to perform the operation of FIG. 7 for each frame. In some examples, ABB 314A may perform an operation to update $\alpha_l$ on a periodic basis, such as once every n'th frame, where n is an integer (e.g., an integer between 2 and 100).

Additionally, ABB 314A may obtain a value of $\alpha_c$ (702). ABB 314A may obtain the value of $\alpha_c$ in various ways. For example, ABB 314A may obtain the value of $\alpha_c$ from a memory unit, such as a register or RAM module. In this example, transceiver 310A (FIG. 3) may receive updated values of $\alpha_c$ from hearing assistance device 102B and may store the updated values of $\alpha_c$ into the memory unit. Transceiver 310A may receive updated values of $\alpha_c$ according to various schedules or regimes. For instance, transceiver 310A may receive an updated value of $\alpha_c$ for each frame, each n frames, each time a given amount of time has passed, each time the value of $\alpha_c$ as determined by hearing assistance device 102B changes, each time the value of $\alpha_c$ changes by at least a particular amount, or in accordance with other schedules or regimes.

In the example of FIG. 7, ABB 314A may identify an optimized value of $\alpha_l$. The optimized value of $\alpha_l$ is a final value of the first parameter determined by performing an optimization process that comprises one or more iterations of steps that includes steps (704) through (722). Particularly, in the example of FIG. 7, ABB 314A may generate a candidate audio signal based on the first input audio signal, the second input audio signal, and the current value of $\alpha_l$ (704). The current value of $\alpha_l$ may be the initialized value of $\alpha_l$ or a value of $\alpha_l$ that has been changed as described below. ABB 314A may generate the candidate audio signal according to equation (1) (i.e., $Z_l=Y_{lv}-\alpha_l Y_{diff}$). Thus, in one example, as part of generating the candidate audio signal, ABB 314A may generate a difference signal ($Y_{diff}$) based on a difference between the first input audio signal ($Y_{lv}$) and the second input audio signal ($Y_{cv}$). Furthermore, in this example, ABB 314A may generate a scaled difference signal (e.g., $\alpha_l Y_{diff}$) based on the difference signal scaled by the current value of the first parameter. In this example, ABB 314A may generate the candidate audio signal based on a difference between the first input audio signal and the scaled difference signal.

ABB 314A may modify the current value of $\alpha_l$ in a direction of decreasing output values of a cost function. Inputs of the cost function may include the candidate audio signal. The cost function may be a composition of one or more component functions. The component functions may include a function relating output powers of the candidate audio signal and the values of the first parameter. For instance, equation (2) is an example of the cost function that maps values of $\alpha_l$ to output powers of the candidate audio signal. In various examples, ABB 314A may modify the value of $\alpha_l$ in various ways. For instance, in the example of FIG. 7, ABB 314A may perform actions (706) through (716), as described below, to modify the value of $\alpha_l$.

Particularly, in the example of FIG. 7, ABB 314A may determine a gradient of the cost function at a current value of $\alpha_l$ (706). As described elsewhere in this disclosure, the cost function may be the output power of candidate audio signal calculated according to equation (2) (i.e., $J_l=Z_l Z_l^*$). In an example where the cost function is described in equation (2), to determine the gradient of the cost function, ABB 314A may calculate a derivative of the cost function (e.g., as described above with respect to equation (3)).

ABB 314A may then determine whether the gradient is greater than 0 (708). If the gradient is greater than 0 ("YES" branch of 708), ABB 314A may decrease $\alpha_l$ (710). Otherwise, if the gradient is less than 0 ("NO" branch of 708), ABB 314A may increase $\alpha_l$ (712).

Thus, in some examples, ABB 314A may determine a gradient of the cost function at the value of $\alpha_l$. Additionally, ABB 314A may determine the direction of decreasing output values of the cost function based on whether the gradient is positive or negative. To modify the value of $\alpha_l$, ABB 314A may decrease the value of $\alpha_l$ based on the gradient being positive or increase the value of $\alpha_l$ based on the gradient being negative.

ABB 314A may increase or decrease $\alpha_l$ is various ways. For example, ABB 314A may always increment or decrement $\alpha_l$ by the same amount. In some examples, ABB 314A may modify the amount by which $\alpha_l$ is incremented or decremented based on whether the slope is greater than 0 but was previously less than 0 or is less than 0 but was previously greater than 0. If either such condition occurs, ABB 314A may have skipped over a minimum point as a result of the most recent increase or decrease of $\alpha_l$. Accordingly, in such examples, ABB 314A may increase or decrease $\alpha_l$ by an amount less than that which ABB 314A previously used to increase or decrease at. In some examples, ABB 314A may determine the amount by which ABB 314A increases or decreases $\alpha_l$ as a function of the gradient. In such examples, higher absolute values of the gradient may correspond to larger amounts by which to increase or decrease $\alpha_l$. In some examples, ABB 314A may determine a normalized amount by which to modify the value of $\alpha_l$ as described elsewhere in this disclosure (e.g., with respect to equation (4)).

After increasing or decreasing $\alpha_l$, ABB 314A may determine a scaling factor c based on $\alpha_l$ (714). As noted above scaling factor c may be a value between 0 and 1. For instance, ABB 314A may determine the scaling factor using equation (9), as described elsewhere in this disclosure.

Subsequently, ABB 314A may set the value of $\alpha_l$ based on the modified value of at (e.g., the increased or decreased value of $\alpha_l$) scaled by the scaling factor (716). For instance, ABB 314 may calculate a new current value of $\alpha_l$ by calculating $\alpha_l=\alpha_l \cdot c$, as described in equation (10). ABB 314A may then regenerate the candidate audio signal based on the new current value of $\alpha_l$ as set in (718).

ABB 314A may output the regenerated candidate audio signal as the output audio signal (720). Thus, the first output audio signal of FIG. 6 may comprise the candidate audio signal that is based on the first input audio signal, the second input audio signal, and the optimized value of $\alpha_l$. For instance, ABB 314A may send electrical impulses corresponding to the output audio signal ($Z_l$) to a receiver (e.g., receiver 218 (FIG. 2)).

Furthermore, transceiver 310A may send the final value of $\alpha_l$ to the contra hearing assistance device (e.g., hearing assistance device 102B) (722). The contra hearing assistance device may use the received value of $\alpha_l$ as $\alpha_c$. Transceiver 310A may send the value of $\alpha_l$ according to various schedules or regimes. For instance, transceiver 310A may send the value of $\alpha_l$ for each frame, each n frames, each time a given amount of time has passed, each time the value of $\alpha_l$ as determined by hearing assistance device 102A changes, each time the value of $\alpha_l$ changes by at least a particular amount, or in accordance with other schedules or regimes. In some examples, ABB 314A may send values of $\alpha_l$ to the contra hearing assistance device at a rate less than once per frame of the first output audio signal. In some examples, ABB 314A quantizes the final value of $\alpha_l$ prior to sending the final value of $\alpha_l$ to the contra hearing assistance device. Quantizing the final value of $\alpha_l$ may include rounding the final value of $\alpha_l$, reducing a bit depth of the final value of $\alpha_l$, or other actions to constrain the set of values of $\alpha_l$ to a smaller set of possible values of $\alpha_l$.

Furthermore, it is noted above that ABB 314A may seek to minimize an output value of a cost function. In some examples, the cost function is a composition of one or more component functions. For instance, rather than the cost function being the output power of the candidate audio signal as described in equation (2), the optimization problem can be stated as follows:

$$\text{Minimize } J_1+J_2$$

$$\text{Subject to } \alpha_l+\alpha_c-\delta_{msc}\alpha_l\alpha_c\leq\gamma_{msc}$$

$$0\leq\alpha_l\leq0.5$$

$$0\leq\alpha_c\leq0.5 \tag{16}$$

In (16), $J_1$ is the output power of audio signal $Z_l$ and $J_2$ is the output power of audio signal $Z_c$. This problem has a convex objective function $J_1+J_2$ in terms of $\alpha_l$ and $\alpha_c$. The constraints also give a convex set (see FIG. 5A). Existing tools can be used to solve this optimization problem, including the interior point method described in Boyd S. et al "Convex Optimization," Cambridge University Press, pp. 561-621. Thus, in this example, ABB 314A may perform an optimization process that optimizes both $\alpha_l$ and $\alpha_c$.

Thus, in one such example, the candidate audio signal may be considered a first candidate audio signal and the scaled difference signal may be considered a first scaled difference signal. In this example, as part of the steps in the optimization process, ABB 314A may further generate a second scaled difference signal based on the difference signal scaled by the value of $\alpha_c$ (i.e., the second parameter). Additionally, ABB 314A may generate a second candidate audio signal. The second candidate audio signal is based on a difference between the second input audio signal and the second scaled difference signal. Furthermore, in this example, ABB 314A may modify the value of $\alpha_c$ in a direction of decreasing output values of the cost function. The inputs of the cost function may further include values of the second parameter. The component functions may further include a function relating output powers of the second candidate audio signal to the values of the second parameter. For instance, as discussed above with respect to equation (16), the cost function may be $J_1+J_2$, where $J_1$ is the function relating the output powers of the first candidate audio signal to the values of the first parameter, and $J_2$ is the function relating the output powers of the second candidate audio signal to the values of the first parameter. In this example, ABB 314A may determine the scaling factor based on the modified value of $\alpha_l$, the modified value of $\alpha_c$, and the coherence threshold (e.g., using equation (9)). In this example, ABB 314A may then set the value of $\alpha_c$ based on the modified value of $\alpha_c$ by the scaling factor (e.g., using equation (10) with $\alpha_c$ in place of at).

Figure 8:
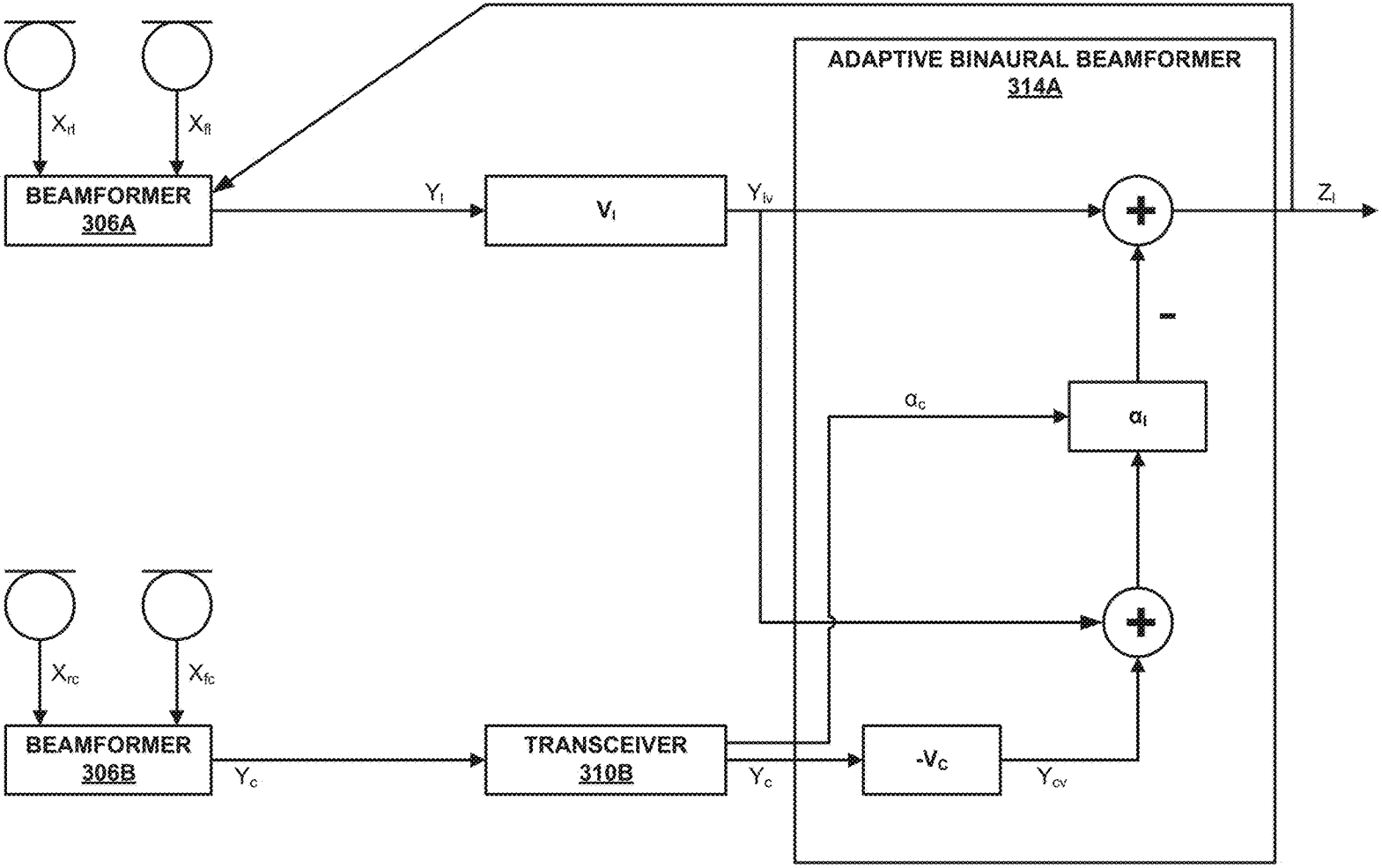
FIG. 8 is a conceptual diagram of a second exemplary implementation of an adaptive binaural beamformer, in accordance with one or more techniques of this disclosure.

FIG. 8 is a conceptual diagram of a second exemplary adaptive beamformer 700, in accordance with one or more techniques of this disclosure. In some of the examples provided above, each of hearing assistance devices 102 only optimizes the local parameter $\alpha_l$. Hence, there is only one degree of freedom, which may result in an immediate trade-off between noise reduction and spatial impression preservation. FIG. 8 shows an example set-up of an adaptive binaural beamformer which also adapts the local beamformer in a manner similar to that described above with respect to ABB 314A. This may help to reduce noise of a single interfering sound source.

Thus, when the example of FIG. 8 is applied within the context of FIG. 6 and FIG. 7, hearing assistance system 100 may obtain first frames of a first set of two or more audio signals, each audio signal in the first set of audio signals being associated with a different microphone in the first set of microphones. Additionally, hearing assistance system 100 may obtain first frames of a second set of two or more audio signals, each audio signal in the second set of audio signals being associated with a different microphone in the second set of microphones. As part of obtaining the first input audio signal, hearing assistance system 100 may apply a first local beamformer to the first frames of the first set of audio signals to generate a first frame of the first input audio signal. Furthermore, in this example, as part of obtaining the second input audio signal, hearing assistance system 100 may apply a second local beamformer to the first frames of the second set of audio signals to generate a first frame of the second input audio signal. As part of applying the first adaptive beamformer, hearing assistance system 100 may generate a first frame of the first output audio signal. As part of applying the second adaptive beamformer, hearing assistance system 100 may generate a first frame of the second output audio signal. Furthermore, in this example, hearing assistance system 100 may update the first local beamformer based on the first frame of the first output audio signal. Hearing assistance system 100 may update the first local beamformer based on the first frame of the first output audio signal in accordance with examples provided elsewhere in this disclosure. Additionally, hearing assistance system 100 may update the second local beamformer based on the first frame of the second output audio signal. Furthermore, hearing assistance system 100 may obtain second frames of the first set of audio signals and may obtain second frames of the second set of audio signals. In this example, hearing assistance system 100 may apply the updated first local beamformer to the second frames of the first set of audio signals to generate a second frame of the first input audio signal. Hearing assistance system 100 may also apply the updated second local beamformer to the second frames of the second set of audio signals to generate a second frame of the second input audio signal. In this example, hearing assistance system 100 may apply the first adaptive binaural beamformer to the second frame of the first input audio signal and the second frame of the second input audio signal to generate a second frame of the first output audio signal.

Figure 9A:
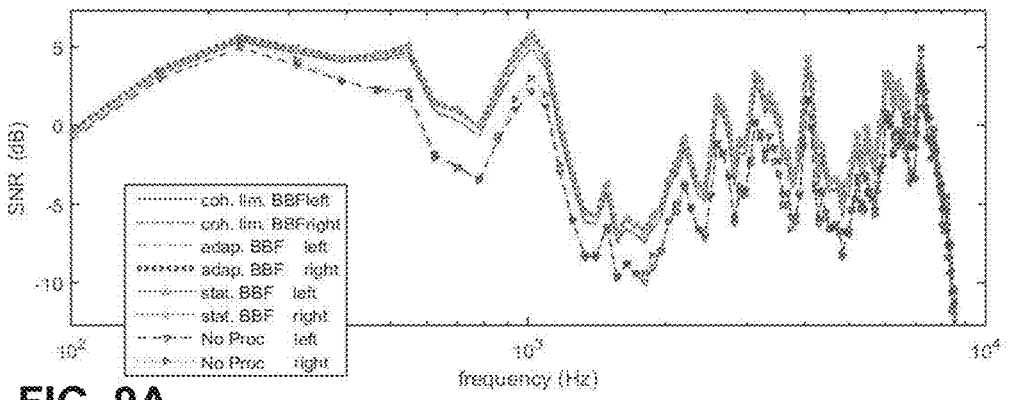
FIG. 9A illustrates example signal-to-noise ratios (SNRs) produced under different conditions.
Figure 9B:
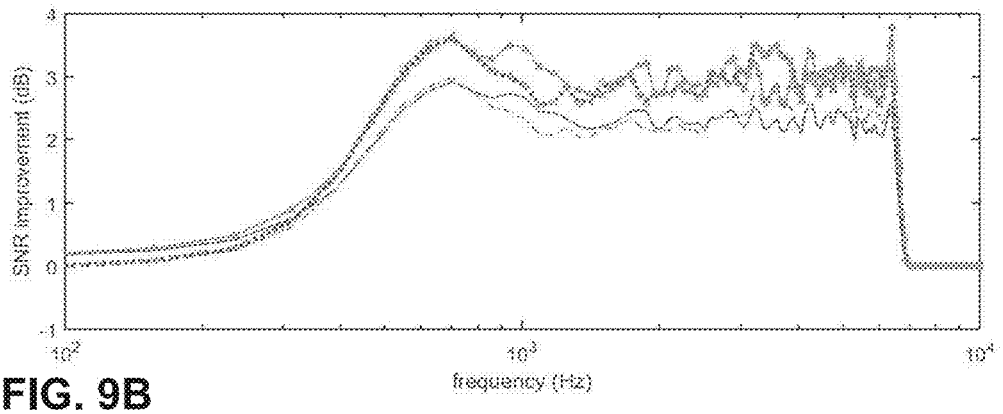
FIG. 9B illustrates example SNR improvements in the conditions of FIG. 9A.
Figure 9C:
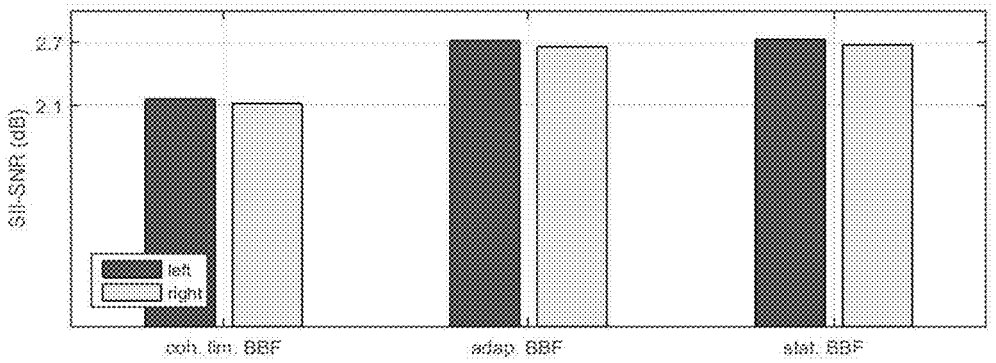
FIG. 9C illustrates example speech intelligibility index-weighted SNR improvements in the conditions of FIG. 9A.

FIG. 9A illustrates example signal-to-noise ratios (SNRs) produced under different conditions. FIG. 9B illustrates example SNR improvements in the conditions of FIG. 9A. FIG. 9C illustrates example speech intelligibility index-weighted SNR improvements in the conditions of FIG. 9A. FIG. 9A, FIG. 9B, and FIG. 9C may show a benefit of the techniques of this disclosure. In FIGS. 9A-9C, hearing assistance devices 102 each have one omni-directional microphone, there is speech coming from the user's front, and there is diffuse babble noise. The SNR is around 0 dB. The binaural beamformer is set up as follows:

Bandwidth limited to 6.25 kHz

Window-OverLap-Add (WOLA)-gains for the contra-signal are shaped as a first order high-pass filter with cut-off frequency 750 Hz to keep ITD cues at low frequency.

The coherence-limited binaural beamformer (BBF) limits the coherence to 0.5 but it incorporates the same high-pass shape as the high-pass filter (e.g. less coherence below 750 Hz).

FIG. 9A shows the SNR of the input and output signals. FIG. 9B shows the SNR improvement relative to the unprocessed condition. A static BBF has an SNR improvement of 3 dB for frequencies above 1 kHz. In a static BBF, the value of $\alpha_l$ is static. This is the expected improvement because the two microphone signals are uncorrelated for a diffuse noise field at these frequencies. The adaptive BBF has a similar SNR improvement which is expected because the noise field is diffuse. The coherence-limited BBF described in this disclosure has an SNR improvement that is roughly 0.5 dB lower than the SNR improvements of the adaptive and static BBF. Because the coherence limit is an additional constraint, the SNR improvement is expected to decrease. FIG. 9C shows the Speech Intelligibility Index weighted SNR improvement (SII-SNR) of the coherence-limited BBF, the adaptive BBF, and the static BBF. The SII-SNR is 2.7 dB for the static and adaptive BBF and 2.1 dB for the coherence-limited BBF.

Figure 10:
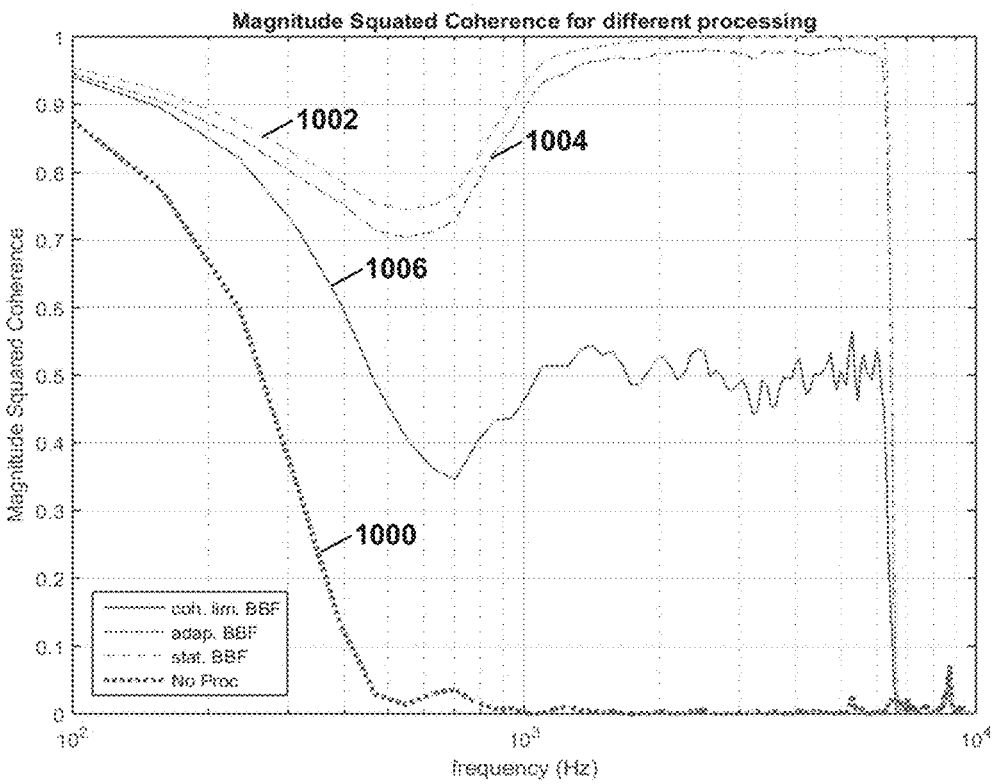
FIG. 10 is a graph showing example magnitude squared coherence (MSC) values of noise.

FIG. 10 is a graph showing example MSC values of noise. In FIG. 10, line 1000 is the MSC of signals $Z_l$ and $Z_c$ without processing. Line 1000 shows that there is very little MSC above 1 kHz. The MSC of the static and adaptive BBFs, as shown by lines 1002 and 1004 are very close to 1 for frequencies between 1 and 6 kHz. Below 1 kHz, there is a dip in the MSC because of a high-pass filter. The MSC of the adaptive BBF filter is slightly lower than the MSC of the static BBF filter because the two hearing assistance devices 102 adapt independently and therefore the left and right output signals slightly differ. Line 1006 indicates the MSC of the coherence-limited BBF. The coherence-limited BBF has a MSC of 0.5 for frequencies between 1 and 6 kHz (as dictated by the constraint). Below 1 kHz, the MSC has a dip which is because of the high-pass shape.

Figure 11A:
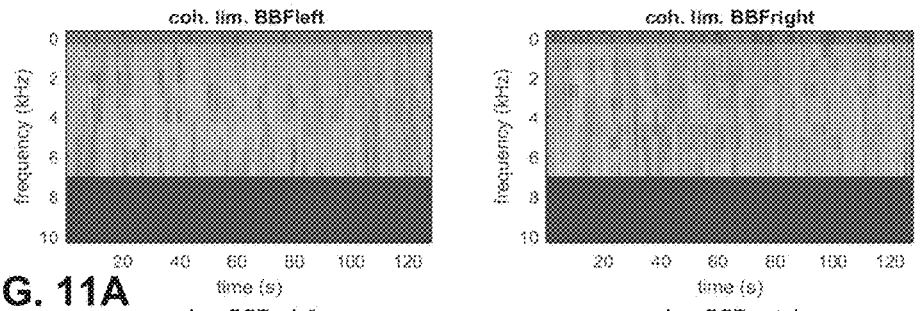
FIG. 11A shows example values of local parameter $\alpha_l$ used by a coherence-limited binaural beamformer (BBF).
Figure 11B:
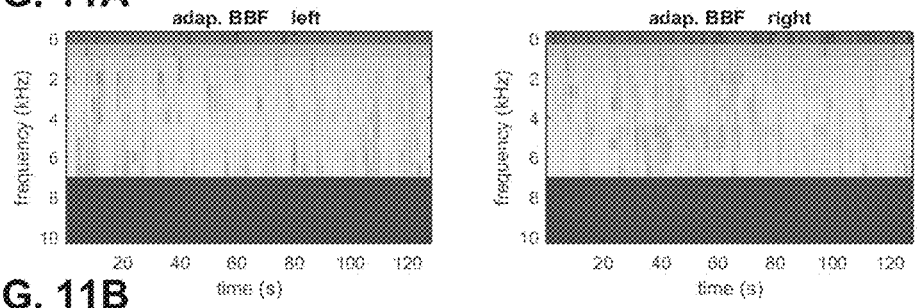
FIG. 11B shows example values of local parameter $\alpha_l$ when an adaptive BBF changes values of local parameter $\alpha_l$ continuously.
Figure 11C:
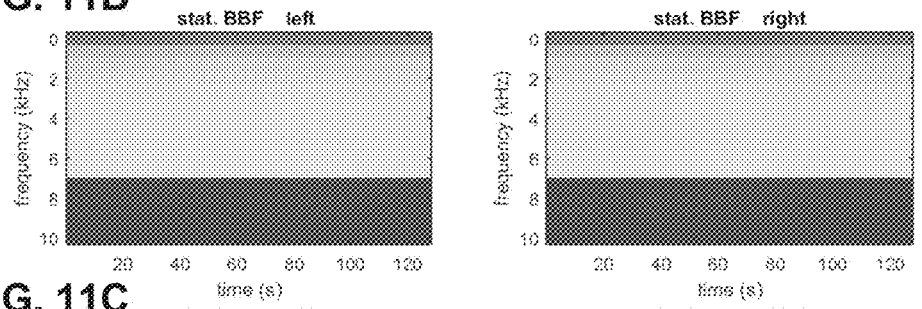
FIG. 11C shows example values of local parameter $\alpha_l$ when a static BBF uses a coefficient $\alpha$ of 0.5 for frequencies between 1 and 6 kHz and a high-pass filter is applied to lower frequencies.
Figure 11D:
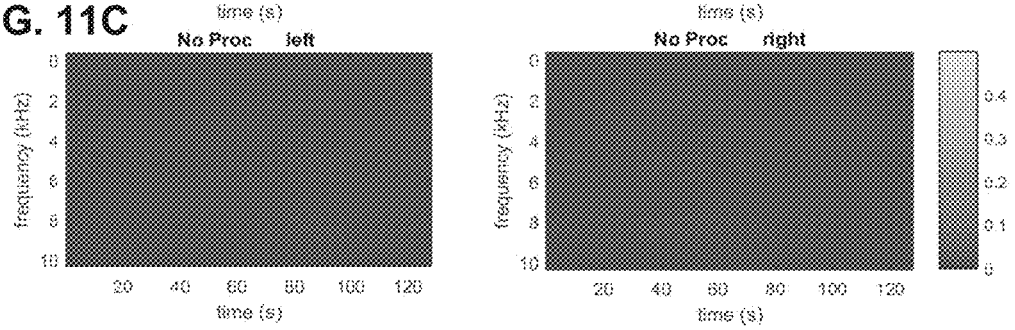
FIG. 11D shows example values of local parameter $\alpha_l$ with no BBF processing (local parameter $\alpha_l$ is 0).

FIGS. 11A-11D show values of local parameter $\alpha_l$ as function of time and frequency for the different processing and the left and right hearing assistance devices 102. Particularly, FIG. 11D shows example values of local parameter $\alpha_l$ with no BBF processing (local parameter $\alpha_l$ is 0). FIG. 11C shows example values of local parameter at when a static BBF uses a value of local parameter $\alpha_l$ of 0.5 for frequencies between 1 and 6 kHz and a high-pass filter is applied to lower frequencies. FIG. 11B shows example values of local parameter $\alpha_l$ when an adaptive BBF changes values of local parameter $\alpha_l$ continuously. As shown in FIG. 11B, the values of local parameter $\alpha_l$ are close to 0.5, which is the expected optimum solution, but which may result in high coherence with the associated loss of spatial cues. FIG. 11A shows example values of local parameter $\alpha_l$ used by a coherence-limited BBF. As shown in FIG. 11A, the value of local parameter $\alpha_l$ are mostly between 0.2 and 0.3. The values of local parameters $\alpha_l$ of the left and right hearing assistance devices 102 are complementary as enforced by the constraint on the coherence. Hence, FIG. 11A show that the coherence-limited BBF may preserve the spatial impression by limiting the MSC to a pre-defined amount.

FIGS. 9A-9C show that the adaptive and static beamformer achieve similar SNR improvements. This may be not surprising given the fact that FIGS. 9A-9C were generated based on a noise field that is diffuse and the adaptive beamformer will converge to the same solution as the static beamformer. Although diffuse noise fields are the most common type of noise fields, noise fields can also be non-diffuse, at least temporarily. The following describes a simple example of an acoustic scenario where the adaptive beamformer improves over the static beamformer. The acoustic scenario contains a target at 0 degrees, 1 interferer at 140 degrees (to the right of the listener) with SIR=0 dB and a low level of background noise SNR=20 dB. There is 1 microphone in a left hearing assistance device and 1 microphone in a right hearing assistance device. The results are shown in FIGS. 12A-12C.

Figure 12A:
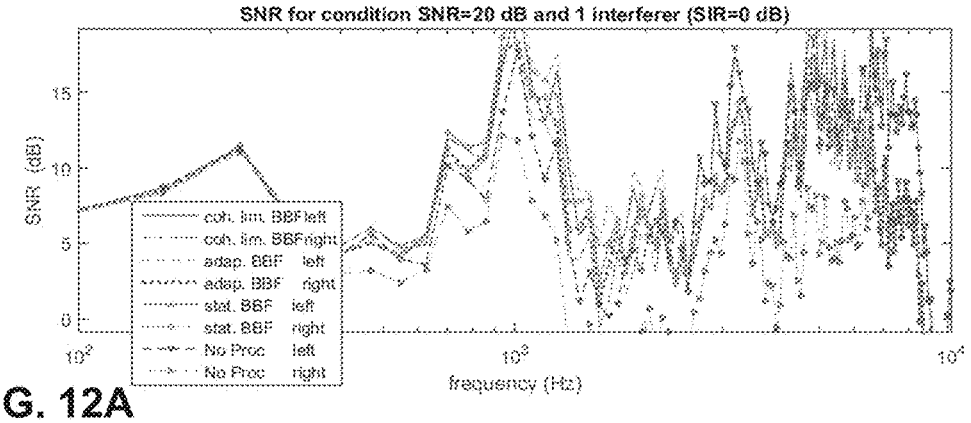
FIG. 12A shows example SNR values versus frequency for the different modes and sides.
Figure 12B:
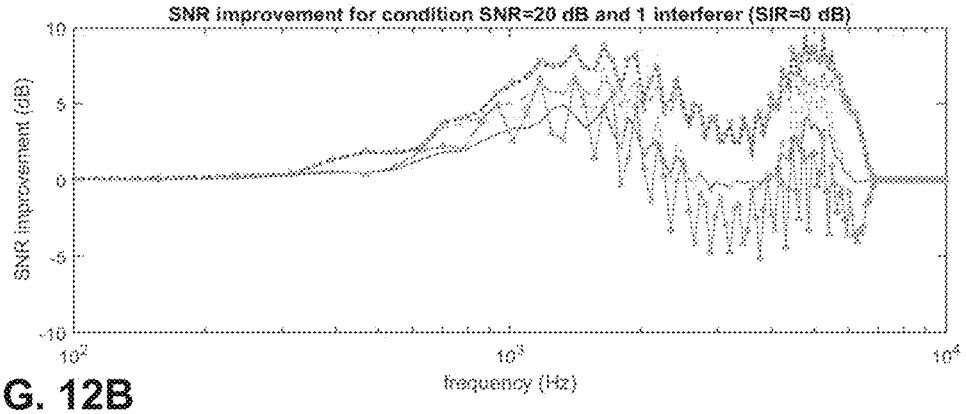
FIG. 12B shows the SNR improvement versus frequency for the different modes and sides (relative to unprocessed).
Figure 12C:
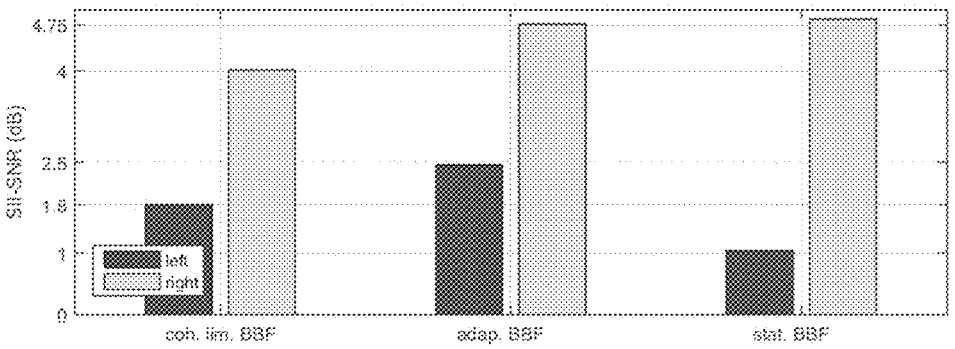
FIG. 12C shows the SNR SII-weighted improvement for the different modes and sides.

FIG. 12A shows example SNR values versus frequency for the different modes and sides. FIG. 12B shows the SNR improvement versus frequency for the different modes and sides (relative to unprocessed). FIG. 12C shows the SNR SII-weighted improvement for the different modes and sides.

In static mode, the SII-weighted SNR improvement for the left HA is significantly lower than the right HA, because the left hearing assistance device is furthest away from the noise and adding the right microphone signal to the left hearing assistance device will not improve SNR much. In adaptive mode, the SII-SNR of the left hearing assistance device is 1.5 dB higher than the static mode. In the coherence limited BBF, the SII-SNR improvement of the left hearing assistance device is 0.8 dB higher than the static mode. For the right hearing assistance device (closest to the noise source), the static BBF (which averages left and right HA) still provides the highest SII-SNR.

Figure 13:
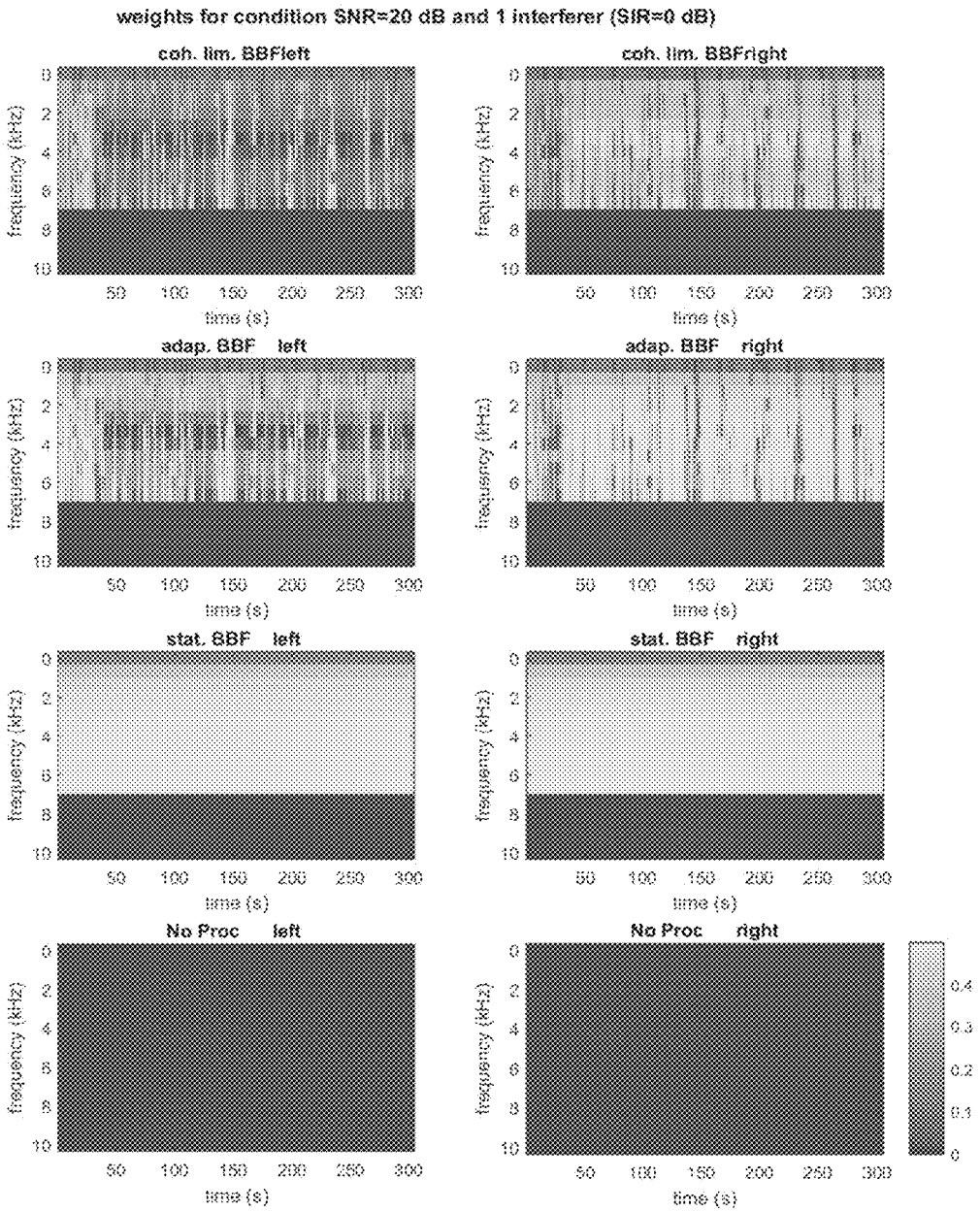
FIG. 13 shows example values of local parameter $\alpha_l$ for coherence limited binaural beamforming, adaptive binaural beamforming, static binaural beamforming, and no processing.

FIG. 13 shows example values of local parameter $\alpha_l$ for coherence limited binaural beamforming, adaptive binaural beamforming, static binaural beamforming, and no processing. A comparison of FIG. 13 with FIG. 11 provides insight in the differences with the diffuse field. The weights in the left hearing assistance device are lower for this solution than for the diffuse field indicating that the left hearing assistance device mainly uses the signal of the left hearing assistance device (further away from the interferer). In summary, the example of FIGS. 12A-12C and FIG. 13 shows that an adaptive solution may be able to provide a better SNR improvement for non-diffuse acoustic conditions. Because this solution only contains 2 microphones, there is only one degree of freedom and the SNR improvement is quite limited.

Figure 14:
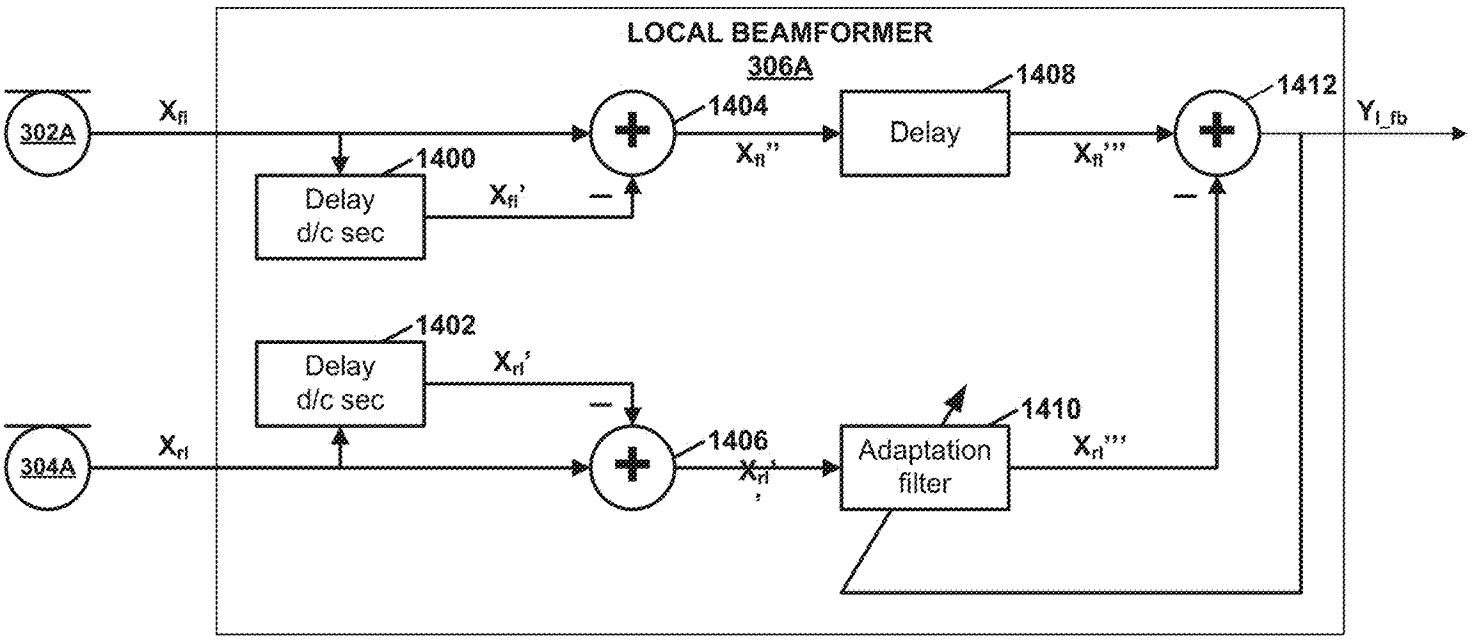
FIG. 14 is a block diagram illustrating an example implementation of a local beamformer.

FIG. 14 is a block diagram illustrating an example implementation of local beamformer 306A. Local beamformer 306B may be implemented in a similar fashion. In the example of FIG. 14, local beamformer 306A receives signal $X_{fl}$ and $X_{rl}$ from microphones 302A and 304A. Furthermore, a delay unit 1400 of local beamformer 306A applies a delay to a first copy of signal $X_{fl}$, generating signal $X_{fl}'$. A delay unit 1402 of local beamformer 306A applies a delay to a signal $X_{rl}$, generating signal $X_{rl}'$. The delays applied to signals $X_{fl}$ and $X_{rl}$ are equal to d/c seconds, where d is a distance between microphones 302A, 304A, and c is the speed of sound. A combiner unit 1404 of local beamformer 306A sums signal $X_{fl}$ and a negative of signal $X_{fl}'$, thereby generating $X_{fl}''$. A combiner unit 1406 of local beamformer 306A sums signal $X_{rl}$ and a negative of signal $X_{rl}'$, thereby generating signal $X_{rl}''$.

Furthermore, a delay unit 1408 of local beamformer 306A applies a delay to signal $X_{fl}''$, thereby generating signal $X_{fl}''$. An adaptive filter unit 1410 of local beamformer 306A applies an adaptive filter to signal $X_{rl}'''$, thereby generating signal $X_{rl}'''$. The adaptive filter may be a finite-impulse response (FIR) filter. A combiner unit 1412 sums signal $X_{fl}'''$ and a negative of signal $X_{rl}'''$, thereby generating signal $Y_{l_fb}$. Delay unit 1408 aligns signal $X_{fl}'''$ with delayed output of the adaptive filter (i.e., signal $X_{rl}'''$. In general, longer adaptive filters are associated with finer frequency resolution by greater delays.

Other implementations of local beamformer 306A may be used in hearing assistance devices that implement the techniques of this disclosure. For instance, in one example, delay unit 1408 may be replaced by a first filter bank. Furthermore, in this example, adaptive filter unit 1410 may be replaced with a second filter bank and an adaptive gain unit. In this example, the filter banks may separate signals $X_{fl}''$ and $X_{rl}'''$ into frequency bands. The gain applied by the gain unit may be adapted independently in each of the frequency bands.

Although the examples provided elsewhere in this disclosure describe operations performed in hearing assistance devices, other examples in accordance with the techniques of this disclosure may involve other computing devices. For instance, in one example, a hearing assistance device may transmit parameters $\alpha_l$ and $\alpha_c$ by way of another device, such as a mobile phone. In this example, the mobile phone may also analyze an environment of a user in a more elaborate manner and this analysis could be used to change the constraint on the MSC of $Z_l$ and $Z_c$. In other words, a mobile device may determine the coherence threshold. For instance, if the mobile phone analysis shows that the user is in a car or in traffic (where spatial cues are very important), the coherence threshold for the MSC of $Z_l$ and $Z_c$ may be set to reduce the coherence of $Z_l$ and $Z_c$.

In this disclosure, ordinal terms such as "first," "second," "third," and so on, are not necessarily indicators of positions within an order, but rather may simply be used to distinguish different instances of the same thing. Examples provided in this disclosure may be used together, separately, or in various combinations.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. For instance, the various beamformers of this disclosure may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processing circuits to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, cache memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. Also, the techniques could be fully implemented in one or more circuits or logic elements. Processing circuits may be coupled to other components in various ways. For example, a processing circuit may be coupled to other components via an internal device interconnect, a wired or wireless network connection, or another communication medium.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. A method for hearing assistance, the method comprising:

obtaining a first input audio signal that is based on sound received by a first set of microphones associated with a first hearing assistance device;

obtaining a second input audio signal that is based on sound received by a second, different set of microphones associated with a second hearing assistance device, the first and second hearing assistance devices being wearable concurrently on different ears of a same user;

determining a coherence threshold;

applying a first adaptive beamformer to the first input audio signal and the second input audio signal, the first adaptive beamformer generating a first output audio signal based on the first input audio signal, the second input audio signal, and a value of a first parameter;

applying a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold;

outputting, by the first hearing assistance device, the first output audio signal; and outputting, by the second hearing assistance device, the second output audio signal.

2. The method of claim 1, wherein applying the first adaptive binaural beamformer comprises:

identifying an optimized value of the first parameter, wherein the optimized value of the first parameter is a final value of the first parameter determined by performing an optimization process that comprises one or more iterations of steps that include:

generating a candidate audio signal based on the first input audio signal, the second input audio signal, and a value of the first parameter;

modifying the value of the first parameter in a direction of decreasing output values of a cost function, wherein inputs of the cost function include the candidate audio signal, and the cost function is a composition of one or more component functions, the component functions including a function relating output powers of the candidate audio signal and the values of the first parameter;

determining a scaling factor based on the modified value of the first parameter, the value of the second parameter, and the coherence threshold; and setting the value of the first parameter based on the modified value of the first parameter scaled by the scaling factor, wherein the first output audio signal comprises the candidate audio signal that is based on the first input audio signal, the second input audio signal, and the optimized value of the first parameter.

3. The method of claim 2, wherein:

the method further comprises sending the final value of the first parameter to the second hearing assistance device, and the second hearing assistance device uses the final value of the first parameter as the value of the second parameter.

4. The method of claim 2, further comprising sending values of the first parameter to the second hearing assistance device at a rate less than once per frame of the first output audio signal.

5. The method of claim 2, further comprising quantizing the final value of the first parameter prior to sending the final value of the first parameter to the second hearing assistance device.

6. The method of claim 2, wherein determining the scaling factor comprises determining the scaling factor based on:

$$c = \frac{(\alpha_1 + \alpha_c) - \sqrt{(\alpha_1 + \alpha_c)^2 - 4\delta_{msc}\alpha_1\alpha_c\gamma_{msc}}}{2\delta_{msc}\alpha_1\alpha_c}$$

wherein c is the scaling factor, $\alpha_1$ is the value of the first parameter, $\alpha_c$ is the value of the second parameter, and $\delta_{MSC}$ and $\gamma_{MSC}$ are defined based on the coherence threshold.

7. The method of claim 2, wherein:

the steps further comprises:

determining a gradient of the cost function at the value of the first parameter; and determining the direction of decreasing output values of the cost function based on whether the gradient is positive or negative, and modifying the value of the first parameter comprises one of:

decreasing the value of the first parameter based on the gradient being positive; or increasing the value of the first parameter based on the gradient being negative.

8. The method of claim 2, wherein generating the candidate audio signal comprises:

generating a difference signal based on a difference between the first input audio signal and the second input audio signal;

generating a scaled difference signal based on the difference signal scaled by the value of the first parameter; and generating the candidate audio signal based on a difference between the first input audio signal and the scaled difference signal.

9. The method of claim 8, wherein:

the candidate audio signal is a first candidate audio signal, the scaled difference signal is a first scaled difference signal, the steps further include:

generating a second scaled difference signal based on the difference signal scaled by the value of the second parameter;

generating a second candidate audio signal, wherein the second candidate audio signal is based on a difference between the second input audio signal and the second scaled difference signal; and modifying the value of the second parameter in a direction of decreasing output values of the cost function, wherein the inputs of the cost function further include values of the second parameter, and the component functions further include a function relating output powers of the second candidate audio signal to the values of the second parameter;

determining the scaling factor comprises determining the scaling factor based on the modified value of the first parameter, the modified value of the second parameter, and the coherence threshold; and the steps further include setting the value of the second parameter based on the modified value of the second parameter scaled by the scaling factor.

10. The method of claim 9, wherein:

the cost function is $J_1+J_2$, $J_1$ is the function relating the output powers of the first candidate audio signal to the values of the first parameter, and $J_2$ is the function relating the output powers of the second candidate audio signal to the values of the first parameter.

11. The method of claim 2, wherein the cost function maps values of the first parameter to output powers of the candidate audio signal.

12. The method of claim 1, wherein:

the method further comprises:

obtaining first frames of a first set of two or more audio signals, each audio signal in the first set of audio signals being associated with a different microphone in the first set of microphones;

obtaining first frames of a second set of two or more audio signals, each audio signal in the second set of audio signals being associated with a different microphone in the second set of microphones, obtaining the first input audio signal comprises applying a first local beamformer to the first frames of the first set of audio signals to generate a first frame of the first input audio signal, obtaining the second input audio signal comprises applying a second local beamformer to the first frames of the second set of audio signals to generate a first frame of the second input audio signal, applying the first adaptive beamformer comprises generating a first frame of the first output audio signal, applying the second adaptive beamformer comprises generating a first frame of the second output audio signal, the method further comprises:

updating the first local beamformer based on the first frame of the first output audio signal;

updating the second local beamformer based on the first frame of the second output audio signal;

obtaining second frames of the first set of audio signals;

obtaining second frames of the second set of audio signals;

applying the updated first local beamformer to the second frames of the first set of audio signals to generate a second frame of the first input audio signal;

applying the updated second local beamformer to the second frames of the second set of audio signals to generate a second frame of the second input audio signal; and applying the first adaptive binaural beamformer to the second frame of the first input audio signal and the second frame of the second input audio signal to generate a second frame of the first output audio signal.

13. A hearing assistance system comprising:

a first hearing assistance device;

a second hearing assistance device, the first and second hearing assistance devices being wearable concurrently on different ears of a same user; and one or more processors configured to:

obtain a first input audio signal that is based on sound received by a first set of microphones associated with a first hearing assistance device;

obtain a second input audio signal that is based on sound received by a second, different set of microphones associated with a second hearing assistance device;

determine a coherence threshold;

apply a first adaptive beamformer to the first input audio signal and the second input audio signal, the first adaptive beamformer generating a first output audio signal based on the first input audio signal, the second input audio signal, and a value of a first parameter; and apply a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold, wherein the first hearing assistance device is configured to output the first output audio signal, and wherein the second hearing assistance device is configured to output the second output audio signal.

14. The hearing assistance system of claim 13, wherein the one or more processors are configured such that, as part of applying the first adaptive binaural beamformer, the one or more processors:

identify an optimized value of the first parameter, wherein the optimized value of the first parameter is a final value of the first parameter determined by performing an optimization process that comprises one or more iterations of steps that include:

generating a candidate audio signal based on the first input audio signal, the second input audio signal, and a value of the first parameter;

modifying the value of the first parameter in a direction of decreasing output values of a cost function, wherein inputs of the cost function include the candidate audio signal, and the cost function is a composition of one or more component functions, the component functions including a function relating output powers of the candidate audio signal and the values of the first parameter;

determining a scaling factor based on the modified value of the first parameter, the value of the second parameter, and the coherence threshold; and setting the value of the first parameter based on the modified value of the first parameter scaled by the scaling factor, wherein the first output audio signal comprises the candidate audio signal that is based on the first input audio signal, the second input audio signal, and the optimized value of the first parameter.

15. The hearing assistance system of claim 14, wherein:

the one or more processors are further configured to send the final value of the first parameter to the second hearing assistance device, the second hearing assistance device uses the final value of the first parameter as the value of the second parameter.

16. The hearing assistance system of claim 14, wherein the one or more processors are configured to send values of the first parameter to the second hearing assistance device at a rate less than once per frame of the first output audio signal.

17. The hearing assistance system of claim 14, wherein the one or more processors are further configured to quantize the final value of the first parameter prior to sending the final value of the first parameter to the second hearing assistance device.

18. The hearing assistance system of claim 14, wherein the one or more processors are configured such that, as part of determining the scaling factor, the one or more processors determine the scaling factor based on:

$$c = \frac{(\alpha_1 + \alpha_c) - \sqrt{(\alpha_1 + \alpha_c)^2 - 4\delta_{msc}\alpha_1\alpha_c\gamma_{msc}}}{2\delta_{msc}\alpha_1\alpha_c}$$

wherein c is the scaling factor, $\alpha_l$ is the value of the first parameter, $\alpha_c$ is the value of the second parameter, and $\delta_{MSC}$ and $\gamma_{MSC}$ are defined based on the coherence threshold.

19. The hearing assistance system of claim 14, wherein:
the steps further comprise:
determining a gradient of the cost function at the value of the first parameter; and
determining the direction of decreasing output values of the cost function based on whether the gradient is positive or negative, and
modifying the value of the first parameter comprises one of:
decreasing the value of the first parameter based on the gradient being positive; or
increasing the value of the first parameter based on the gradient being negative.

20. The hearing assistance system of claim 14, wherein the one or more processors are configured such that, as part of generating the candidate audio signal, the one or more processors:
generate a difference signal based on a difference between the first input audio signal and the second input audio signal;
generate a scaled difference signal based on the difference signal scaled by the value of the first parameter; and
generate the candidate audio signal based on a difference between the first input audio signal and the scaled difference signal.

21. The hearing assistance system of claim 20, wherein:
the candidate audio signal is a first candidate audio signal,
the scaled difference signal is a first scaled difference signal,
the steps further include:
generating a second scaled difference signal based on the difference signal scaled by the value of the second parameter;
generating a second candidate audio signal, wherein the second candidate audio signal is based on a difference between the second input audio signal and the second scaled difference signal; and
modifying the value of the second parameter in a direction of decreasing output values of the cost function, wherein the inputs of the cost function further include values of the second parameter, and the component functions further include a function relating output powers of the second candidate audio signal to the values of the second parameter;
the one or more processors are configured such that, as part of determining the scaling factor, the one or more processors determine the scaling factor based on the modified value of the first parameter, the modified value of the second parameter, and the coherence threshold; and
the steps further include:
setting the value of the second parameter based on the modified value of the second parameter scaled by the scaling factor.

22. The hearing assistance system of claim 21, wherein:
the cost function is $J_1+J_2$,
$J_1$ is the function relating the output powers of the first candidate audio signal to the values of the first parameter, and
$J_2$ is the function relating the output powers of the second candidate audio signal to the values of the first parameter.

23. The hearing assistance system of claim 14, wherein the cost function maps values of the first parameter to output powers of the candidate audio signal.

24. The hearing assistance system of claim 13, wherein:
the one or more processors are further configured to:
obtain first frames of a first set of two or more audio signals, each audio signal in the first set of audio signals being associated with a different microphone in the first set of microphones; and
obtain first frames of a second set of two or more audio signals, each audio signal in the second set of audio signals being associated with a different microphone in the second set of microphones,
the one or more processors are configured such that, as part of obtaining the first input audio signal, the one or more processors apply a first local beamformer to the first frames of the first set of audio signals to generate a first frame of the first input audio signal,
the one or more processors are configured such that, as part of obtaining the second input audio signal, the one or more processors apply a second local beamformer to the first frames of the second set of audio signals to generate a first frame of the second input audio signal,
the one or more processors are configured such that, as part of applying the first adaptive beamformer, the one or more processors generate a first frame of the first output audio signal,
the one or more processors are configured such that, as part of applying the second adaptive beamformer, the one or more processors generate a first frame of the second output audio signal,
the one or more processors are further configured to:
update the first local beamformer based on the first frame of the first output audio signal;
update the second local beamformer based on the first frame of the second output audio signal;
obtain second frames of the first set of audio signals;
obtain second frames of the second set of audio signals;
apply the updated first local beamformer to the second frames of the first set of audio signals to generate a second frame of the first input audio signal;
apply the updated second local beamformer to the second frames of the second set of audio signals to generate a second frame of the second input audio signal; and
apply the first adaptive binaural beamformer to the second frame of the first input audio signal and the second frame of the second input audio signal to generate a second frame of the first output audio signal.

25. A non-transitory computer-readable storage medium having instructions stored thereon that, when executed, cause on or more processors of a hearing assistance system to:

obtain a first input audio signal that is based on sound received by a first set of microphones associated with a first hearing assistance device;

obtain a second input audio signal that is based on sound received by a second, different set of microphones associated with a second hearing assistance device, the first and second hearing assistance devices being wearable concurrently on different ears of a same user;

determine a coherence threshold;

apply a first adaptive beamformer to the first input audio signal and the second input audio signal, the first adaptive beamformer generating a first output audio signal based on the first input audio signal, the second input audio signal, and a value of a first parameter;

apply a second adaptive beamformer to the first input audio signal and the second input audio signal, the second adaptive beamformer generating a second output audio signal based on the first input audio signal, the second input audio signal, and a value of a second parameter, wherein the value of the first parameter and the value of the second parameter are determined such that a magnitude squared coherence (MSC) of the first output audio signal and the second output audio signal is less than or equal to the coherence threshold;

output, by the first hearing assistance device, the first output audio signal; and output, by the second hearing assistance device, the second output audio signal.

* * * * *